US008637583B2

(12) United States Patent
Hermanutz et al.

(10) Patent No.: US 8,637,583 B2
(45) Date of Patent: Jan. 28, 2014

(54) FIBER OR FOIL FROM POLYMERS WITH HIGH $T_g$ AND PROCESS FOR THEIR MANUFACTURE

(75) Inventors: Frank Hermanutz, August-Laemmle-Weg (DE); Mark G. Reichmann, Roswell, GA (US)

(73) Assignee: Solvay Advanced Polymers, L.L.C., Alpharetta, GA (US)

( * ) Notice: Subject to any disclaimer, the term of this patent is extended or adjusted under 35 U.S.C. 154(b) by 232 days.

(21) Appl. No.: 13/124,078

(22) PCT Filed: Oct. 16, 2009

(86) PCT No.: PCT/EP2009/063572

§ 371 (c)(1),
(2), (4) Date: Apr. 18, 2011

(87) PCT Pub. No.: WO2010/043705

PCT Pub. Date: Apr. 22, 2010

(65) Prior Publication Data

US 2011/0263729 A1 Oct. 27, 2011

Related U.S. Application Data

(60) Provisional application No. 61/106,177, filed on Oct. 17, 2008.

(51) Int. Cl.
*C08G 75/23* (2006.01)
*B29C 55/28* (2006.01)

(52) U.S. Cl.
USPC ..... 521/64; 521/182; 521/183; 521/184; 521/189; 264/41; 264/178 R; 264/184; 264/194

(58) Field of Classification Search
USPC ..... 264/41, 178 R, 184, 197; 521/64, 182, 521/183, 184, 189
See application file for complete search history.

(56) References Cited

U.S. PATENT DOCUMENTS

| | | | | |
|---|---|---|---|---|
| 3,634,355 | A | 1/1972 | Barr et al. | |
| 4,008,203 | A | 2/1977 | Jones et al. | |
| 4,108,837 | A | 8/1978 | Johnson et al. | |
| 4,175,175 | A | 11/1979 | Farnham et al. | |
| 4,176,222 | A | 11/1979 | Cinderey et al. | |
| 4,342,711 | A * | 8/1982 | Joh et al. | 264/41 |
| 4,481,260 | A | 11/1984 | Nohmi | |
| 4,801,502 | A | 1/1989 | Weinrotter et al. | |
| 5,215,554 | A * | 6/1993 | Kramer et al. | 95/47 |
| 5,258,149 | A * | 11/1993 | Parham et al. | 264/41 |
| 5,290,906 | A | 3/1994 | Matsumura et al. | |
| 5,367,046 | A | 11/1994 | Dorogy et al. | |
| 5,374,708 | A | 12/1994 | Tamai et al. | |
| 5,474,680 | A * | 12/1995 | Eguchi | 210/500.23 |
| 6,017,474 | A * | 1/2000 | Teo et al. | 264/41 |
| 6,248,267 | B1 | 6/2001 | Hosako et al. | |
| 6,566,484 | B2 | 5/2003 | Gharda et al. | |
| 2003/0130476 | A1 | 7/2003 | Kemmish et al. | |
| 2006/0099414 | A1 | 5/2006 | Koops et al. | |

FOREIGN PATENT DOCUMENTS

| | | | |
|---|---|---|---|
| CA | 847963 | A | 7/1970 |
| CN | 1763278 | A | 4/2006 |
| DE | 233385 | A1 | 2/1986 |
| EP | 340572 | A2 | 11/1989 |
| EP | 449063 | A2 | 10/1991 |
| EP | 1627941 | A1 | 2/2006 |
| GB | 1134961 | A | 11/1968 |
| WO | WO 03097221 | A1 | 11/2003 |

OTHER PUBLICATIONS

Cabasso I., et al.—"Polysulfone Hollow Fibers. I. Spinning and Properties", Journal of Applied Polymer Science, 1976, vol. 20, pp. 2377-2394, John Wiley & Sons, Inc.; 18 pgs.
Yilmaz, F. and Cakmak, M.—"Melt Spinning Effects on Optical and Mechanical Properties of Poly(Aryl Sulfone)", International Polymer Processing, 1994, 9(2), 141-147, Hanser Publishers, Münich; 7 pgs.
Sun Z., et al.—"Compound Core-Shell Polymer Nanofibers by Co-Electrospinning", Advanced Materials, 2003, vol. 15, No. 22, p. 1929-1932, Wiley-VCH Verlag GMBH & Co. KGaA, Weinheim; 4 pgs.
Moch Irving Jr.—"Membranes, Hollow-Fiber", Kirk-Othmer Encyclopedia of Chemical Technology online, 2005, vol. 16; 31 pgs.

* cited by examiner

*Primary Examiner* — Irina S Zemel
(74) *Attorney, Agent, or Firm* — Osha Liang LLP

(57) ABSTRACT

A process for the manufacture of a fiber or foil comprising at least one optionally functionalized polymer with a high Tg selected from the group consisting of poly(aryl ether sulfone) (PAES), poly(aryl ether ketone) (PAEK) and aromatic polyimide, comprising the steps of (aa) providing a solution comprising at least 45 wt. % of the polymer, and at least 20 wt. %, of at least one halogen-free organic solvent (S1) for the polymer, both wt % based upon the weight of the solution;

(bb) pushing the solution through a nozzle; and (cc) introducing the solution into a coagulation bath comprising:

(cc1) at least one liquid (L1) in which the polymer is insoluble, and optionally (cc2) at least one organic solvent (S2) for the polymer, identical to or different from the organic solvent (S1), to form a fiber or foil. A fiber or foil obtained by this process as well as to fibers or foils with specific porosity features and/or mechanical properties.

10 Claims, 4 Drawing Sheets

FIBER OR FOIL FROM POLYMERS WITH HIGH $T_g$ AND PROCESS FOR THEIR MANUFACTURE

CROSS REFERENCE TO RELATED APPLICATIONS

The present application is a U.S. national stage entry under 35 U.S.C. §371 of International Application No. PCT/EP2009/063572 filed Oct. 16, 2009, which claims the priority benefit to U.S. provisional application No. 61/106,177 filed on Oct. 17, 2008, the whole content of this application being herein incorporated by reference for all purposes.

The present invention relates to a fiber or foil comprising an optionally functionalized polymer with a high $T_g$, in particular from polycondensation polymers with high $T_g$, and a process for their manufacture.

The manufacture of a high elongation and/or high strength (in the following to be referred to also as "high tenacity"), continuous fiber of a high $T_g$ polymer, for example of poly (aryl ether sulfone) in a solution spinning process is extremely difficult due to the material's propensity to form weak, brittle and highly porous fibers. In fact, due to their high porosity these materials are used as a component in membranes. The known fibers are however extremely brittle, with fiber elongation at break of <10%. As a result, these fibers cannot be used for necessary fiber post processing operations like weaving and/or threading.

On the other hand, the production of fibers from functionalized high $T_g$ polymers by melt extrusion is extremely difficult due to the reactive nature of the polymer. During said melt extrusion, the reactive end-groups are consumed and can cause the polymer viscosity to increase dramatically. In some instances, this even renders fiber manufacturing impossible, especially at high, commercially relevant production rates.

GB1134961 discloses a process for the production of threads of a polyarylsulfone which comprises wet spinning a solution consisting essentially of a polyarylsulfone in an organic solvent into a coagulating bath consisting of 5 to 90% by volume of the organic solvent and 95 to 10% by volume of a liquid in which the polyarylsulfone is insoluble and with which said solvent is miscible. In a preferred embodiment, the organic solvent is chloroform and the polymer concentration in the spinning solution is 15 to 40 grams per 100 ml of chloroform (i.e., ca. 9 to 21% by weight). Preferably, after leaving the coagulating bath and while still in the wet state, the thread is subjected to a stretching treatment, advantageously by 100 to 300%. Moreover, the poly(aryl sulfone) spun has preferably a relative viscosity, measured on a 1% by weight solution in chloroform at 30° C., which is in the range of 1.6 to 4.2. In Example 1, a solution of a polyarylsulfoneether (made from bisphenol-A and 4,4'-dichlorodiphenylsulphone) was spun at a speed of 11 m/min through a spinneret with 20 orifices 80 μm in diameter into a coagulation bath at 20° C. containing 60 volume %-EtOH and 40 volume % $CHCl_3$. After leaving the 100 cm long coagulation bath, the fibers were washed in a 40-cm long bath with EtOH. The moist fibers were stretched by 200% between two rolls rotating at different speeds.

The fibers disclosed in GB1134961 of 1967 are substantially porous and very weak. Accordingly, there was so far no commercial application.

DD 233385 A1 relates to a process for the manufacture of porous polymer bodies which are suitable as fiber-type products for use in the textile industry, for the manufacture of composite materials or in plane or tubular form as membranes. Porous polymeric shaped objects are produced by coagulation of a polymer solution, preferentially of acrylonitrile polymer or copolymer, in which 1-60 weight % of the polymer are substituted by an additive such that the finely dispersed additive is insoluble and non-swellable in the solvent and remains in the shaped object. Polysulfones are briefly mentioned in the discussion of the state of the art. The total concentration of the additives and polymer in solution is between 5-25 weight % with a constant concentration of solvent for each designated concentration of polymer and additive in the region of 5-25 weight % independently of the ratio of polymer to additive. The invention aims at providing a technologically simple process for the manufacture of porous bodies, which possess a thermally and mechanically resistant system of hollow spaces.

EP 1 627 941A1 discloses a fiber having a first porous layer and an adjacent second porous layer concentrically arranged therewith, said first porous layer comprising particulate material, said second porous layer comprising a polymeric material, and wherein the pores of the layers are at least permeable to fluid. Preferred polymeric materials are polyethersulfone, polysulfone, polyetherimide, polyimide, polyacrylonitrile, polyethylene-co-vinylalcohol, polyvinylidenefluoride and cellulose esters.

In Example 1 of EP 1 627 941 A1 a homogeneous polymer solution 1 was prepared by mixing 9.5 wt % poly(ether sulfone), 24 wt % polyethylene glycol, 4.5 wt % PVP, 6.8 wt % dry Sepharose FF (34 μm), 6 wt % water and 49.2 wt % N-methylpyrrolidone (NMP). In addition, a homogeneous polymer solution 2 was prepared by mixing 16 wt % polyethersulfone, 38.75 wt % N-methyl pyrrolidone and 6.5 wt % water. Both solutions were extruded simultaneously through a tube-in-orifice spinneret. After passing an air gap of 45 mm, the double layer nascent fibre entered a water bath where phase separation took place.

WO 03/097221 A1 relates to a hollow fiber membrane having supporting material for reinforcement, preparation thereof and a spinneret for preparing the same. In Embodiment 1 on pages 22 and 23, a spun undiluted solution was prepared by melting polyether sulfone as polymer and PVP (poly vinyl pyrrolidone) as additive in NMP. The viscosity of the prepared spun undiluted solution was 2,000 cps at 25° C. A mixture of water and NMP was used as the internal coagulating solution, and DTY (draw twisting yarn) was used as reinforcing support. The spun undiluted solution, the internal coagulating solution, and the reinforcing support were simultaneously discharged to the external coagulating solution for which a mixture of water and NMP was used.

The distance between the spinneret and the external coagulating solution was 10 cm, and the temperature of the coagulating tub was 30° C.

US 2006/0099414 A1 relates to functional porous fibers. In its Example 2, a polysulfone hollow fiber was produced by dissolving 30 wt. % polysulfone (UDEL 3500) and mixing it with 30 wt. % of a styrene-divinylbenzene type cation-exchange resin (Amberlite IR-120) in NMP. The dispersion was extruded through a tube-in-orifice spinneret (OD=2.1 and ID=1.0 mm) into a water bath (16-18° C.) where phase separation occurred. The spinning rate was 0.35 m/min.

U.S. Pat. No. 6,248,267 B1 relates to a method for manufacturing a fibril system fiber, wherein a polymer solution, in which a macromolecular polymer having a film forming ability is dissolved in a solvent (for example poly(ether sulfone), see Example 40, in columns 41 and 42), is extruded into a mixing cell via a spinneret orifice, and simultaneously, a coagulating agent fluid in a gas chase of the macromolecular polymer is sprayed into the mixing cell so as to flow in the direction of the axis of discharge of the polymer solution, the macromolecular polymer coagulates within the mixing cell and fibril system fibers are formed.

Despite these numerous attempts, it is however still a problem to produce solution spun fibers from high $T_g$ polymers, for example from poly(aryl ether sulfones) in that these polymers generally produce weak, brittle fibers, as evidenced by their low strength and low elongation at break. The same is true for the manufacture of foils. On the other hand, meltspun fibers have in general no longer any reactive groups, for example, hydroxyl or amino groups.

An object of the present invention is therefore to provide a fiber and/or foil, as well as a process for their manufacture which allow to overcome these problems.

The invention thus provides in a first aspect a process for the manufacture of a fiber or foil comprising at least one optionally functionalized polymer with a high $T_g$ selected from the group consisting of poly(aryl ether sulfone) (PAES), poly(aryl ether ketone) (PAEK) and aromatic polyimide, comprising the steps of (aa) providing a solution comprising at least 45 wt. %, preferably at least 48 wt. %, more preferably at least 50 wt. %, based upon the weight of the solution, of the polymer, and at least 20 wt. %, based upon the weight of the solution, of at least one halogen-free organic solvent (S1) for the polymer;

(bb) pushing the solution through a nozzle; and (cc) introducing the solution into a coagulation bath comprising (cc1) at least one liquid (L1) in which the polymer is insoluble, and optionally (cc2) at least one organic solvent (S2) for the polymer, identical to or different from the organic solvent (S1), to form a fiber or foil.

The terms "fiber" and "foil" as used herein have to be interpreted broadly.

Accordingly, the term "fiber" relates to all moulds, wherein one dimension (in the following to be referred to also as "length") significantly exceeds the other two dimensions. Preferably, the term "fiber" encompasses moulds wherein the length exceeds the largest dimension vertical to it by a factor of at least 10, preferably of at least 100, even more preferably of at least 10000, and most preferably by a factor of at least 1,000,000.

The term "fiber" as used herein shall include massive and hollow fibers. Moreover the fibers and hollow fibers may contain several layers of which not all layers comprise the polymer from a high $T_g$ polymer. Hollow fibers have no core in the strict sense, but resemble a foil wherein the two ends are connected to each other. The term "core" as used herein shall thus refer to the core of a massive fiber as well as the core of a layer comprising the high $T_g$ polymer in a hollow fiber or a foil.

Accordingly, the term "foil" as used herein shall encompass all moulds wherein two dimensions are significantly larger than the remaining third dimension (the third dimension being referred to also as "thickness"). Thus, the term foil includes a film, sheet, and laminate. The foil can be even or uneven. Moreover, the foil can comprise more than one layer.

The polymer to be used in the process, and the fiber or foil of the present invention is at least one optionally functionalized polymer with a high $T_g$ (glass temperature) selected from the group consisting of poly(aryl ether sulfone) (PAES), poly (aryl ether ketone) (PAEK) and aromatic polyimide. Among these, the preferred polymer is poly(aryl ether sulfone) (PAES).

For the purpose of the invention, a poly(aryl ether sulfone) is intended to denote any polymer, generally a polycondensate, of which more than 50 wt. % of the recurring units are recurring units (R3) of one or more formulae containing at least one arylene group, at least one ether group (—O—) and at least one sulfone group [—S(=O)$_2$—].

Non limitative examples of poly(aryl ether sulfone)s are polymers of which more than 50 wt. %, up to 100 wt. %, of the recurring units are recurring units (R3) of formula (A) and/or (B):

(A)

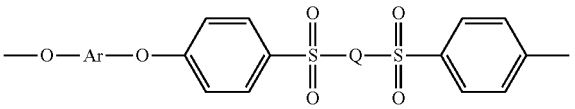

(B)

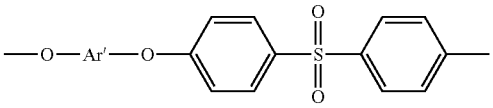

wherein:

Q is a group chosen among the following structures:

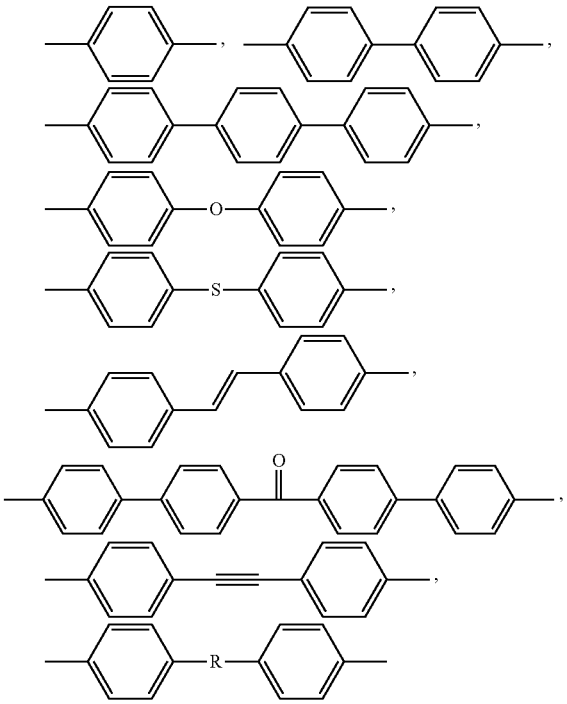

with R being:

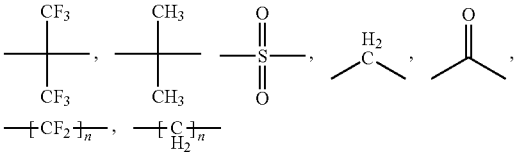

with n=integer from 1 to 6, or an aliphatic divalent group, linear or branched, of up to 6 carbon atoms;

and mixtures thereof;

Ar is a group chosen among the following structures:

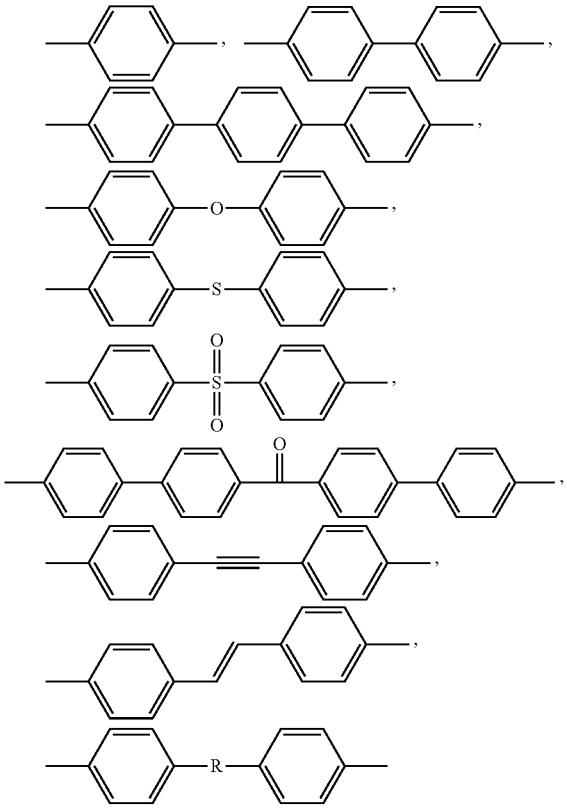

with R being:

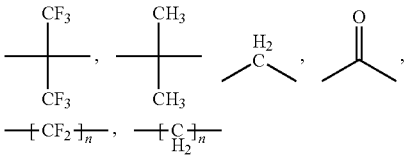

with n=integer from 1 to 6, or an aliphatic divalent group, linear or branched, of up to 6 carbon atoms;

and mixtures thereof;

Ar' is a group chosen among the following structures:

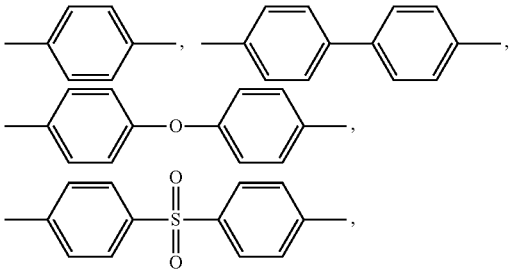

-continued

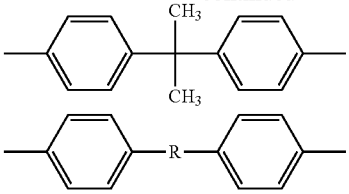

with R being:

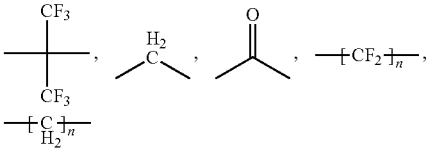

with n=integer from 1 to 6, or an aliphatic divalent group, linear or branched, of up to 6 carbon atoms;

and mixtures thereof.

Among such polymers, it can be particularly cited polymers of which more than 50 wt. %, up to 100 wt. %, of the recurring units are recurring units of one or more of formulae (C), (D), (E) and (F):

(C)

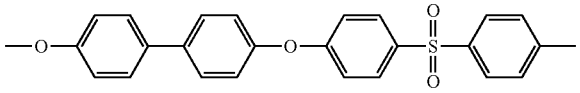

(D)

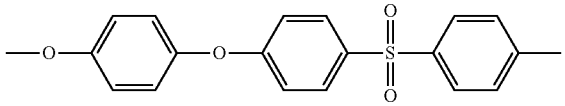

(E)

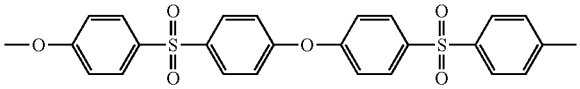

(F)

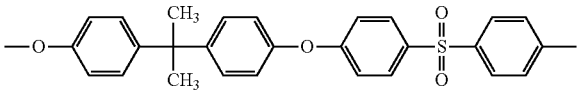

Polymers comprising more than 50 wt. % of recurring units of formula (C) are commonly known as "polyphenylsulfones" and are commercially available notably from SOLVAY ADVANCED POLYMERS, L.L.C. as RADEL® R poly(aryl ether sulfone)s.

Polymers comprising more than 50 wt. % of recurring units of formula (D) are commonly known as "polyetherethersulfones".

Polymers comprising more than 50 wt. % of recurring units of formula (E) are commonly known as polyethersulfones and are commercially available notably from SOLVAY ADVANCED POLYMERS, L.L.C. as RADEL® A poly(aryl ether sulfone)s.

Polymers comprising more than 50 wt. % of recurring units of formula (F) are commonly known as "bisphenol A polysulfones" (or just "polysulfones") and are commercially available notably from SOLVAY ADVANCED POLYMERS, L.L.C. as UDEL®.

The polymer composition may contain one and only one poly(aryl ether sulfone) (P3). Alternatively, the polymer composition may contain two or more poly(aryl ether sulfone)s (P3); for example, it may contain at least one polyphenylsulfone and at least one polysulfone, or at least one polyphenylsulfone and at least one polyethersulfone.

The poly(aryl ether sulfone) (P3) can be prepared by any method. Methods well known in the art are those described in U.S. Pat. Nos. 3,634,355; 4,008,203; 4,108,837 and 4,175,175, the whole content of which is herein incorporated by reference.

EMBODIMENT

E1

In a certain embodiment (E1) of the present invention, the poly(aryl ether sulfone) (P3) is a poly(biphenyl ether sulfone).

For the purpose of the present invention, a poly(biphenyl ether sulfone) is intended to denote a polymer of which more than 50 wt. % of the recurring units are recurring units (R3) of one or more formulae containing at least one p-phenylene group:

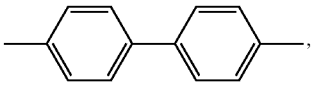

at least one ether group (—O—) and at least one sulfone group [—S(=O)$_2$—].

Recurring units (R3) are preferably of one or more formulae of the general type:

(G)

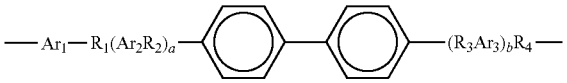

with the proviso that at least one of $R_1$ through $R_4$ is —SO$_2$— and at least one of $R_1$ through $R_4$ is —O—; $Ar_1$, $Ar_2$ and $Ar_3$ are arylene groups containing 6 to 24 carbon atoms, and are preferably phenylene or p-biphenylene; and a and b are either 0 or 1.

More preferably, recurring units (R3) are chosen from (H)

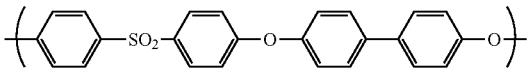

(I)

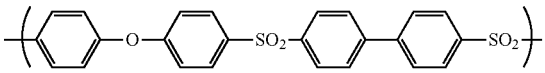

(J)

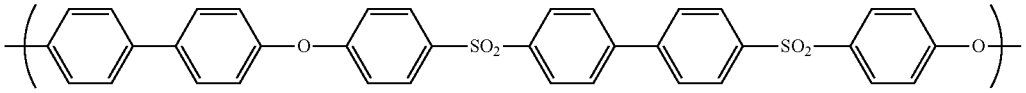

(K)

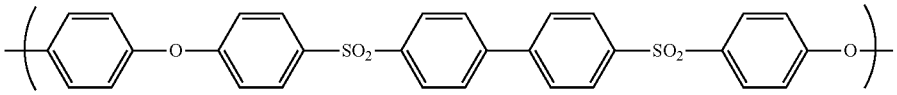

(L)

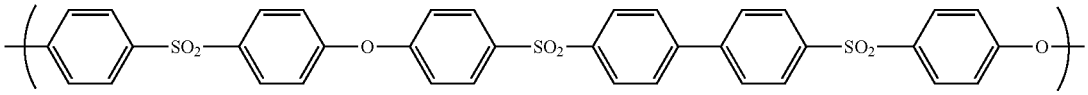

and mixtures thereof.

Still more preferably, recurring units (R3) are chosen from (H)

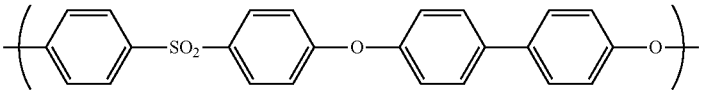

(J)

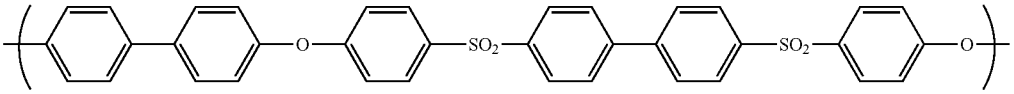

and mixtures thereof.

For the purpose of the present invention, a PPSU polymer is intended to denote any polymer of which more than 50 wt. % of the recurring units are recurring units (R3) of formula (H).

The poly(biphenyl ether sulfone) may be notably a homopolymer or a copolymer such as a random or block copolymer. When the poly(biphenyl ether sulfone) is a copolymer, its recurring units may notably be composed of (i) recurring units (R3) of at least two different formulae chosen from formulae (H) to (L), or (ii) recurring units (R3) of one or more formulae (H) to (L) and recurring units (R3*), different from recurring units (R3), such as:

(K)

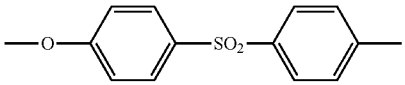

(L)

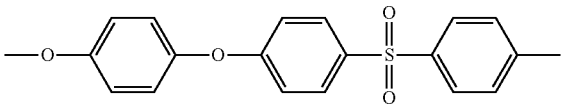

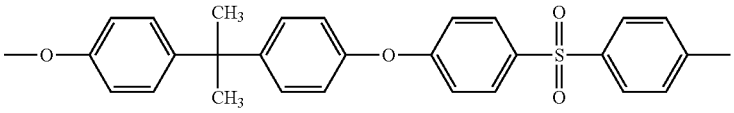

-continued (M)

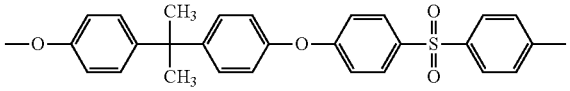

and mixtures thereof.

Preferably more than 90 wt. %, and more preferably more than 95 wt. % of the recurring units of the poly(biphenyl ether sulfone) are recurring units (R3). Still more preferably, all the recurring units of the poly(biphenyl ether sulfone) are recurring units (R3).

Excellent results were obtained when the poly(biphenyl ether sulfone) was a PPSU homopolymer, i.e. a polymer of which all the recurring units are of formula (H). RADEL® R polyphenylsulfone from SOLVAY ADVANCED POLYMERS, L.L.C. is an example of a PPSU homopolymer.

The poly(biphenyl ether sulfone) can be prepared by any method. Methods well known in the art are those described in U.S. Pat. Nos. 3,634,355; 4,008,203; 4,108,837 and 4,175,175, the whole content of which is herein incorporated by reference.

EMBODIMENT

E2

In a certain embodiment (E2) of the present invention, the poly(aryl ether sulfone) is a polysulfone. For the purpose of the present invention, a polysulfone is intended to denote any polymer of which more than 50 wt. % of the recurring units are recurring units (R3) of one or more formulae containing at least one ether group (—O—), at least one sulfone group (—$SO_2$—) et at least one group as shown hereafter:

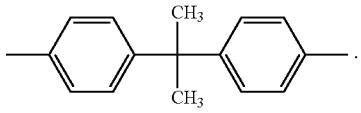

Preferably, recurring units (R3) are chosen from (M)

(N)

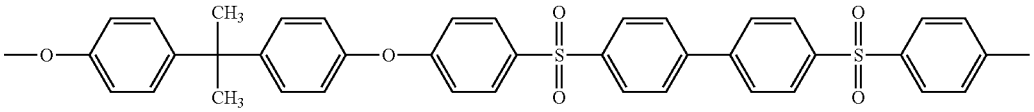

and mixtures thereof.

Very preferably, recurring units (R2) are (M)

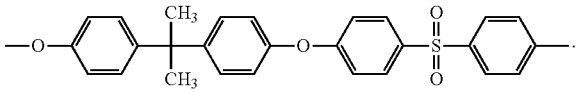

The polysulfone may notably be a homopolymer, a copolymer such as a random or block copolymer. When the polysulfone is a copolymer, its recurring units may notably be composed of (i) recurring units (R3) of formulas (M) and (N), or (ii) on one hand, recurring units (R3) of at least one of formulas (M) and (N), and, on the other hand, recurring units (R3*), different from recurring units (R3), such as:

(O)

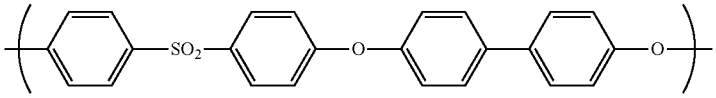

(P)

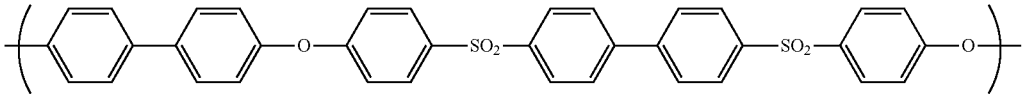

(Q)

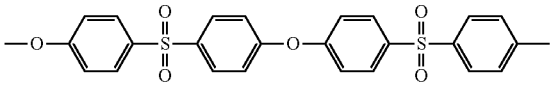

(R)

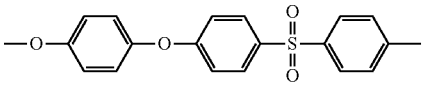

and mixtures thereof.

Preferably more than 90 wt. %, and more preferably more than 95 wt. % of the recurring units of the polysulfone are recurring units (R3). Still more preferably, all the recurring units of the polysulfone are recurring units (R3).

The most preferred polysulfone is a homopolymer of which the recurring units are recurring units (R3) of formula (M)

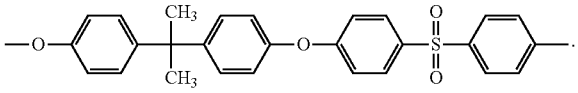

Such a polysulfone homopolymer is notably commercialized by SOLVAY ADVANCED POLYMERS, L.L.C. under the trademark UDEL®.

EMBODIMENT

E3

In a certain embodiment (E3) of the present invention, the poly(aryl ether sulfone) is a polyethersulfone.

To the purpose of the present invention, a polyethersulfone is intended to denote any polymer of which more than 50 wt. % of the recurring units are recurring units (R3) of formula (S)

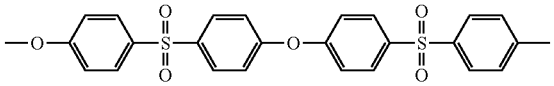

The polyethersulfone may be notably a homopolymer, or a copolymer such as a random or a block copolymer. When the polyethersulfone is a copolymer, its recurring units are advantageously a mix of recurring units (R3) of formula (S) and of recurring units (R3*), different from recurring units (R3), such as:

(T)

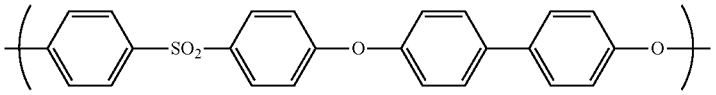

(U)

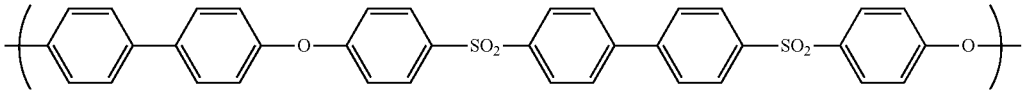

(V)

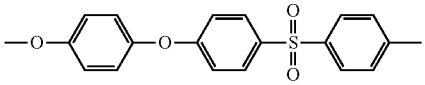

(W)

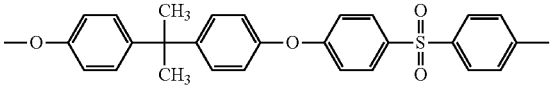

and mixtures thereof.

Preferably, the polyethersulfone is a homopolymer, or it is a copolymer the recurring units of which are a mix composed of recurring units (R3) of formula (S) and of recurring units (R3*) of formula (T), or it can also be a mix of the previously cited homopolymer and copolymer.

SOLVAY ADVANCED POLYMERS, L.L.C. commercializes various polyethersulfones under the trademark RADEL® A.

EMBODIMENT

E4

In a specific embodiment (E4) of the present invention, the poly(aryl ether sulfone) is a polyimidoethersulfone.

For the purpose of the present invention, a polyimidoethersulfone is intended to denote a polymer of which at least 5 wt. % of the recurring units are recurring units (R3) of formula (X), (Y) and/or (Z), as represented below:

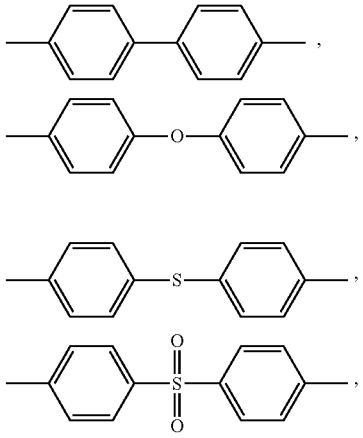

(X)

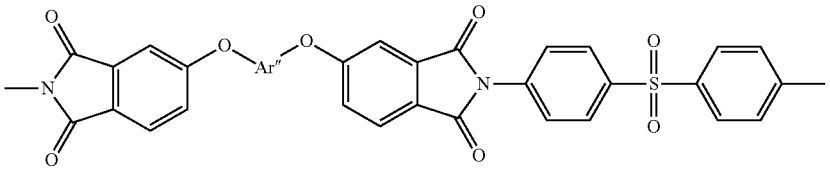

(Y)

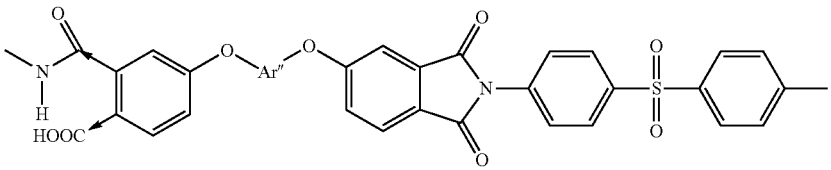

(Z)

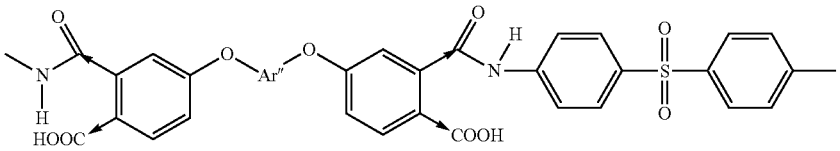

wherein:

(Y) and (Z) are the amic acid forms corresponding to the imide form (X);

the → denotes isomerism so that in any recurring unit the groups to which the arrows point may exist as shown or in an interchanged position;

Ar" is chosen among the following structures:

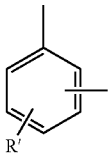

with the linking groups being in ortho, meta or para position and R' being a hydrogen atom or an alkyl radical comprising from 1 to 6 carbon atoms, -continued

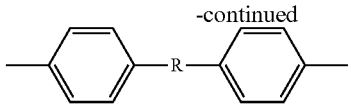

with R being an aliphatic divalent group of up to 6 carbon atoms, such as methylene, ethylene, isopropylene and the like, and mixtures thereof.

Preferably more than 50 wt. %, and more preferably more than 90 wt. % of the recurring units of the polyimidoethersulfone are recurring units (R3). Still more preferably, all the recurring units of the polyimidoethersulfone are recurring units (R3).

The poly(aryl ether sulfones) which are used according to the present invention may be prepared by various methods, for example by the so-called carbonate method. Generally described, the process is conducted by contacting substantially equimolar amounts of at least one aromatic bishydroxy monomer, e.g. 4-4' bisphenol A, 4-4' bisphenol S, or 4,4'-biphenol and at least one dihalodiarylsulfone, e.g., 4,4'-dichlorodiphenyl sulfone, 4,4'-difluorodiphenyl sulfone or the like, with from about 0.5 to about 1.1 mole, preferably from about 1.01 to about 1.1 mole, more preferably from about 1.05 to about 1.1 mole of an alkali metal carbonate, preferably potassium carbonate, per mole of hydroxyl group.

The components are generally dissolved or dispersed in a solvent mixture comprising a polar aprotic solvent together with a solvent which forms an azeotrope with water, whereby water formed as a byproduct during the polymerization may be removed by azeotropic distillation continuously throughout the polymerization.

The polar aprotic solvents employed are those generally known in the art and widely used for the manufacture of poly(aryl ether sulfones). For example, the sulfur-containing solvents known and generically described in the art as dialkyl sulfoxides and dialkylsulfones wherein the alkyl groups may contain from 1 to 8 carbon atoms, including cyclic alkylidene analogs thereof, are disclosed in the art for use in the manufacture of poly(aryl ether sulfones). Specifically, among the sulfur-containing solvents that may be suitable for the purposes of this invention are dimethylsulfoxide, dimethylsulfone, diphenylsulfone, diethylsulfoxide, diethylsulfone, diisopropylsulfone, tetrahydrothiophene-1,1-dioxide (commonly called tetramethylene sulfone or sulfolane) and tetrahydrothiophene-1-monoxide. Nitrogen-containing polar aprotic solvents, including dimethylacetamide, dimethylformamide and N-methyl-pyrrolidinone pyrrolidinone and the like have been disclosed in the art for use in these processes, and may also be found useful in the practice of the present invention.

The solvent that forms an azeotrope with water will necessarily be selected to be inert with respect to the monomer components and polar aprotic solvent. Those disclosed and described in the art as suitable for use in such polymerization processes include aromatic hydrocarbons such as benzene, toluene, xylene, ethylbenzene, chlorobenzene and the like.

The azeotrope-forming solvent and polar aprotic solvent are typically employed in a weight ratio of from about 1:10 to about 1:1, preferably from about 1:5 to about 1:1.

Generally, after an initial heat-up period, the temperature of the reaction mixture will be maintained in a range of from about 160° C. to about 250° C., preferably from about 200° C. to about 230° C., still more preferably from about 200° C. to about 225° C. for about 0.5 to 3 hours. Typically, if the reaction is conducted at atmospheric pressure, the boiling temperature of the solvent selected usually limits the temperature of the reaction.

The reaction may be conveniently carried out in an inert atmosphere, e.g., nitrogen, at atmospheric pressure, although higher or lower pressures may also be used.

It is essential that the reaction medium be maintained substantially anhydrous during the polycondensation. While amounts of water up to about one percent, preferably no more than 0.5 percent by weight, can be tolerated, and are somewhat beneficial when employed with fluorinated dihalobenzenoid compounds, amounts of water substantially greater than this are desirably avoided as the reaction of water with the halo compound leads to formation of phenolic species and low molecular weight products are obtained. Substantially anhydrous conditions may be conveniently maintained during the polymerization by removing water continuously from the reaction mass with the azeotrope-forming solvent as an azeotrope. In the preferred procedure, substantially all of the azeotrope-forming solvent, for example, chlorobenzene, will be removed by distillation as an azeotrope with the water formed in the reaction, leaving a solution comprising the poly(aryl ether sulfone) product dissolved in the polar aprotic solvent.

Sometimes, after the desired molecular weight has been attained, the polymer is endcapped to improve melt and oxidative stability. Generally, the endcapping is accomplished by adding a reactive aromatic halide or an aliphatic halide such as methyl chloride, benzyl chloride or the like to the polymerization mixture, converting any terminal hydroxyl groups into ether groups. In some instances, the polymer is intentionally left with excess hydroxyl groups to produce a reactive polymer. For the present invention it is preferred to use a reactive polymer.

The poly(aryl ether sulfone) is subsequently recovered by methods well known and widely employed in the art such as, for example, coagulation, solvent evaporation and the like. In the particular case of a reactive polymer, the recovery method must avoid reaching temperatures where the polymer will react. Frequently, in case a high excess of hydroxyl endgroups is desired, the polymer reaction is conducted with an excess of the bishydroxy monomer.

The at least one optionally functionalized polymer with a high $T_g$ which is to be used according to the present invention may be a poly(aryl ether ketone) (PAEK). For the purpose of the present invention, the term "poly(aryl ether ketone)" is intended to denote any polymer of which more than 50 wt. % of the recurring units are recurring units (R2) comprising at least one carbonyl group in-between two arylene groups, said recurring units (R2) being of one or more of the following formulae:

(I)

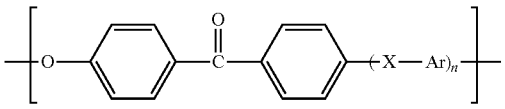

(II)

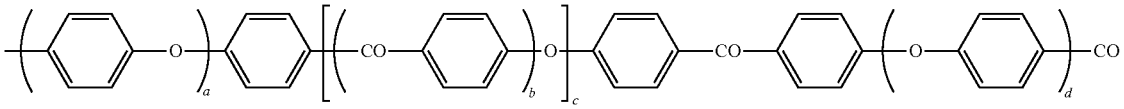

(III)

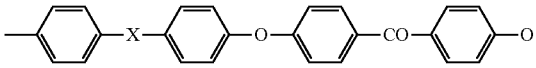

(IV)

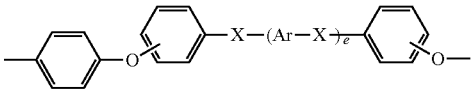

-continued
(V)
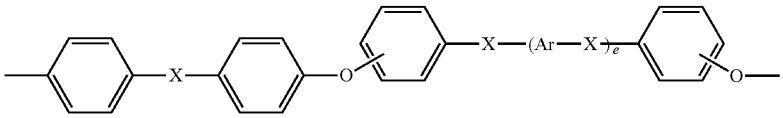
wherein:
Ar is independently a divalent aromatic radical selected from phenylene, biphenylene or naphthylene,
X is independently O, C(═O) or a direct bond,
n is an integer of from 0 to 3,
b, c, d and e are 0 or 1,
a is an integer of 1 to 4, and
preferably, d is 0 when b is 1.
Recurring units (R2) may notably be chosen from among:
(VI)
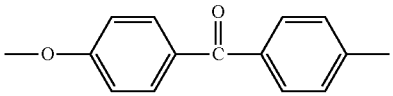
(VII)
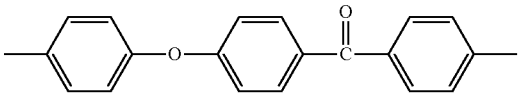
(VIII)
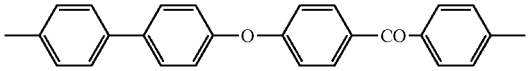
(IX)
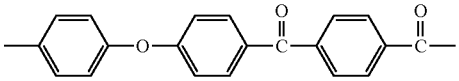
(X)
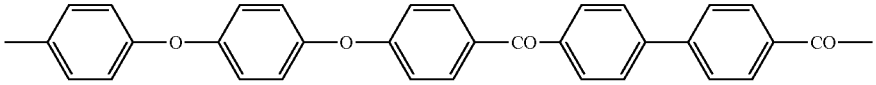
(XI)
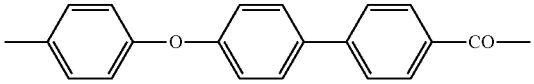
(XII)
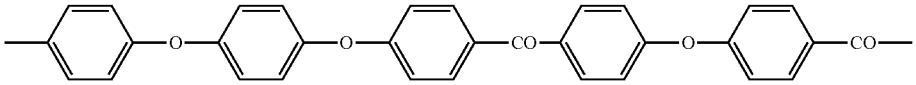
(XIII)
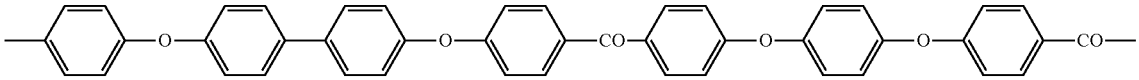
(XIV)
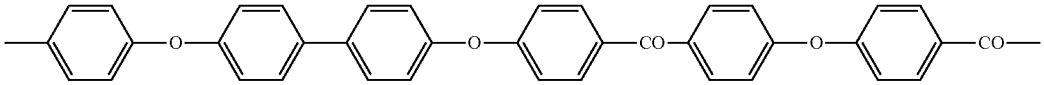
(XV)
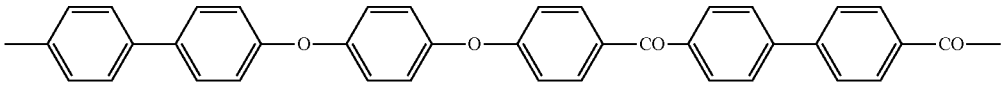
(XVI)
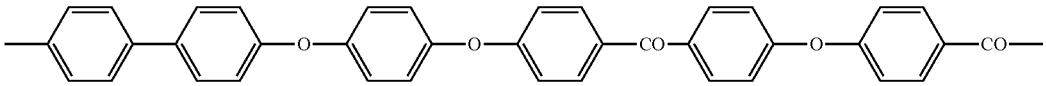
(XVII)
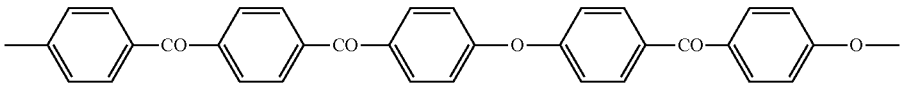
(XVIII)
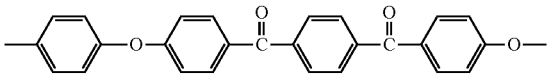
(XIX)
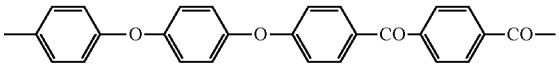
(XX)
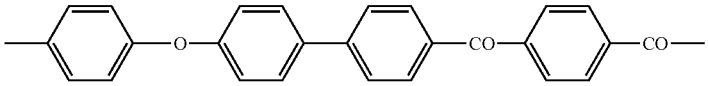
and -continued (XXI)

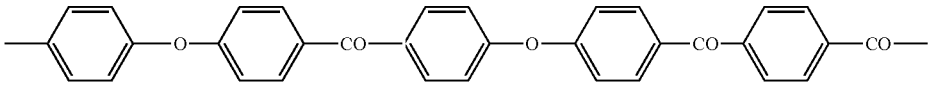

Preferably, recurring units (R2) are chosen from among:

(VII)

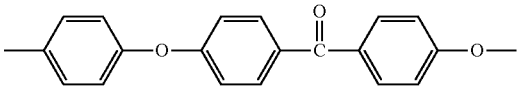

and (IX)

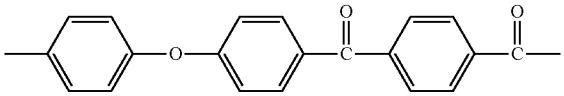

More preferably, recurring units (R2) are:

(VII)

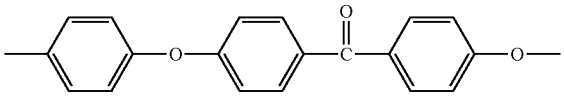

For the purpose of the present invention, a polyetheretherketone is intended to denote any polymer of which more than 50 wt. % of the recurring units are recurring units (R2) of formula (VII).

Preferably more than 70 wt. %, and more preferably more than 85 wt. % of the recurring units of the poly(aryl ether ketone) (P2) are recurring units (R2). Still more preferably, essentially all the recurring units of the poly(aryl ether ketone) (P2) are recurring units (R2). Most preferably, all the recurring units of the poly(aryl ether ketone) (P2) are recurring units (R2).

Good results may be obtained when the poly(aryl ether ketone) (P2) is a polyetheretherketone homopolymer, i.e. a polymer of which essentially all, if not all, the recurring units are of formula (VII). VICTREX® 150 P and VICTREX® 450 P PEEKS from Victrex Manufacturing Ltd., and KETASPIRE® and GATONE® PEEKS from Solvay Advanced Polymers, L.L.C. are examples of polyetheretherketone homopolymers.

The poly(aryl ether ketone) (P2) has advantageously a reduced viscosity (RV) of at least 0.60 dl/g, as measured in 95-98% sulfuric acid (d=1.84 g/ml) at a poly(aryl ether ketone) concentration of 1 g/100 ml. The measurement is performed using a No 50 Cannon-Fleske viscometer. RV is measured at 25° C. in a time less than 4 hours after dissolution, to limit sulfonation. The RV of the poly(aryl ether ketone) (P2) is preferably of at least 0.65 dl/g, more preferably of 0.70 dl/g. Besides, the RV of the poly(aryl ether ketone) (P2) is advantageously of at most 1.20 dl/g, preferably at most 1.10 and still more preferably at most 1.00 dl/g.

The poly(aryl ether ketone) (P2) can be amorphous (i.e. having no melting point) or semi-crystalline (i.e. having a melting point). It is usually semi-crystalline; the case being, the melting point of the poly(aryl ether ketone) (P2) is advantageously greater than 150° C., preferably greater than 250° C., more preferably greater than 300° C. and still more preferably greater than 325° C.

The poly(aryl ketone) (P2) can be prepared by any method.

One well known in the art method contains reacting a substantially equimolar mixture of at least one bisphenol and at least one dihalobenzoid compound or at least one halophenol compound as described in Canadian Pat. No. 847,963. Non limitative example of bisphenols useful in such a process are hydroquinone, 4,4'-dihydroxybiphenyl and 4,4'-dihydroxybenzophenone; non limitative examples of dihalobenzoid compounds useful in such a process are 4,4'-difluorobenzophenone, 4,4'-dichlorobenzophenone and 4-chloro-4'-fluorobenzophenone; non limitative examples of halophenols compounds useful in such a process are 4-(4-chlorobenzoyl)phenol and (4-fluorobenzoyl)phenol. Accordingly, PEEK homopolymers may notably be produced by the nucleophilic process as described in, for example, U.S. Pat. No. 4,176,222, the whole content of which is herein incorporated by reference.

Another well known method to produce PEEK homopolymers comprises electrophilically polymerizing phenoxyphenoxybenzoic acid, using an alkane sulfonic acid as solvent and in the presence of a condensing agent, as the process described in U.S. Pat. No. 6,566,484, the whole content of which is herein incorporated by reference. Other poly(aryl ether ketone)s may be produced by the same method, starting from other monomers than phenoxyphenoxybenzoic acid, such as those described in U.S. Pat. Appl. 2003/0130476, the whole content of which is herein incorporated by reference.

The blend (B) can comprise one and only one poly(aryl ether ketone) (P2). Alternatively, it can comprise two, three, or even more than three poly(aryl ether ketone)s (P2). Certain preferred mixes of poly(aryl ether ketone)s (P2) are: mixes consisting of (i) at least one poly(aryl ether ketone) (P2a) of which more than 50 wt. % of the recurring units, preferably essentially all the recurring units, and still more preferably all the recurring units are of formula (VII)

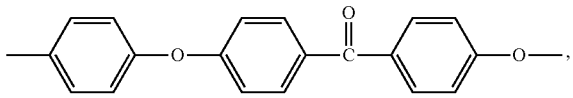

with (ii) at least one poly(aryl ether ketone) (P2b) of which more than 50 wt. % of the recurring units, preferably essentially all the recurring units, and still more preferably all the recurring units are of formula (IX)

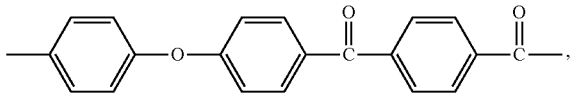

and, optionally in addition, with (iii) at least one other poly (aryl ether ketone) (P2c) different from poly(aryl ether ketone)s (P2a) and (P2b);

in particular, mixes consisting of (i) at least one poly(aryl ether ketone) (P2a) of which essentially all, if not all, the recurring units are of formula (VII) with (ii) at least one poly(aryl ether ketone) (P2b) of which essentially all, if not all, the recurring units are of formula (IX);

still more particularly, binary mixes consisting of (i) one poly(aryl ether ketone) (P2a) of which all the recurring units are of formula (VII) with (ii) one poly(aryl ether ketone) (P2b) of which all the recurring units are of formula (IX).

The at least one optionally functionalized polymer with a high $T_g$ which is to be used according to the present invention may be an aromatic polyimide. The aromatic polyimide (P1) according to the present invention is any polymer of which more than 50 wt. % of the recurring units (R1) comprise at least one aromatic ring and least one imide group.

The imide groups contained in the recurring units (R1) can be imide groups as such [formula (I)] and/or in their amic acid form [formula (II)]:

formula (I)

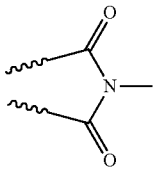

formula (II)

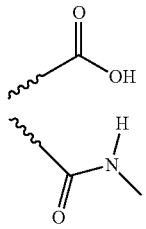

The imide groups, as such and/or in their corresponding amic acid form, are advantageously linked to an aromatic ring, as illustrated below:

formula (III)

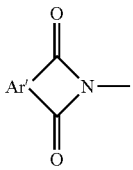

formula (IV)

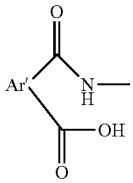

whereas Ar' denotes a moiety containing at least one aromatic ring.

The imide groups are advantageously present as condensed aromatic system, yielding a five- or six-membered heteroaromatic ring, such as, for instance, with benzene[phthalimide-type structure, formula (V)] and naphthalene[naphthalimide-type structure, formula (VI)].

formula (V)

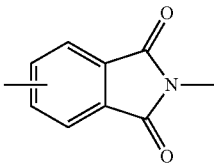

formula (VI)

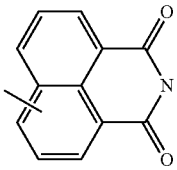

In a first particular embodiment, the recurring units (R1) of the aromatic polyimide (P1) are free from ether and from amide groups other than those possibly included in the amic acid form of the imide groups [recurring units (R1a)].

Recurring units (R1a) are preferably of one or more formulae (VII), (VIII) and (IX) here below:

formula (VII)

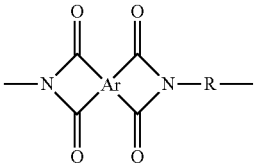

and/or formula (VIII)

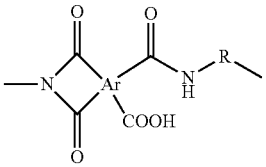

and/or formula (IX)

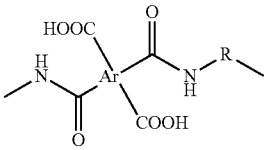

where:

Ar is:

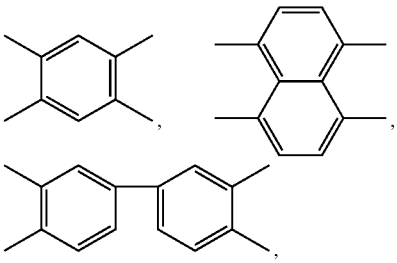

-continued

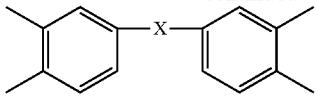

with X=

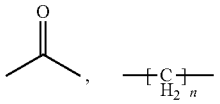

with n=1, 2, 3, 4 or 5;

R is:

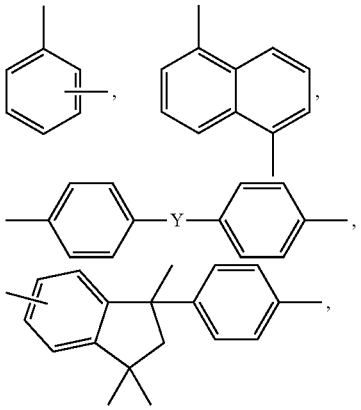

with Y=

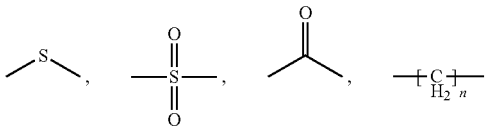

with n=0, 1, 2, 3, 4 or 5.

In a second particular embodiment, the aromatic polyimide (P1) is an aromatic polyamide-imide. For the purpose of the present invention, an aromatic polyamide-imide is intended to denote any polymer of which more than 50 wt. % of the recurring units (R1) comprise at least one aromatic ring, at least one imide group, as such and/or in its amic acid form, and at least one amide group which is not included in the amic acid form of an imide group [recurring units (R1b)].

The recurring units (R1b) are preferably:

(X)

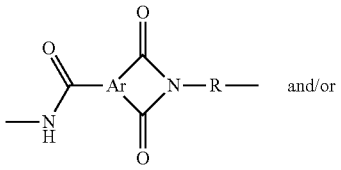

and/or (imide form)

-continued (XI)

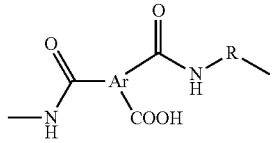

(amic acid form)

where:

Ar is:

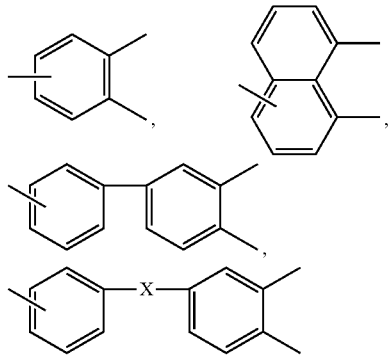

with X=

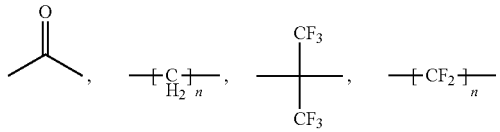

with n=1, 2, 3, 4 or 5;

R is:

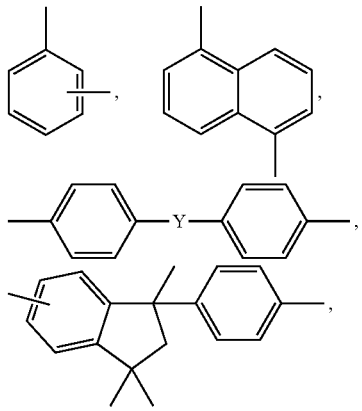

with Y=

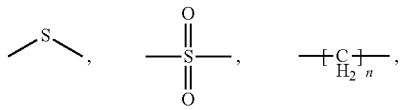

-continued

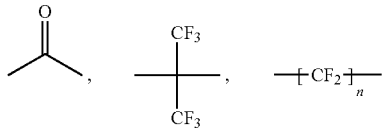

with n=0, 1, 2, 3, 4 or 5.

More preferably, recurring units (R1b) are chosen from:

(R1b-1)

(XII)

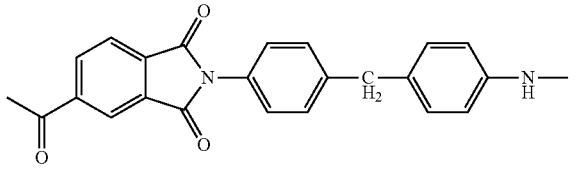

and/or the corresponding amide-amic acid containing recurring unit:

(XIII)

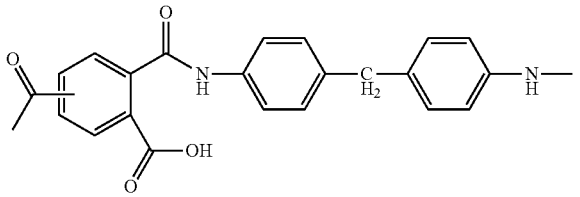

wherein the attachment of the two amide groups to the aromatic ring as shown in (XIII) will be understood to represent the 1,3 and the 1,4 polyamide-amic acid configurations;

(R1b-2)

(XIV)

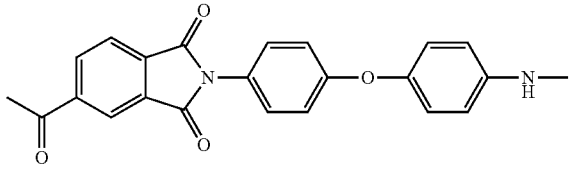

and/or the corresponding amide-amic acid containing recurring unit:

(XV)

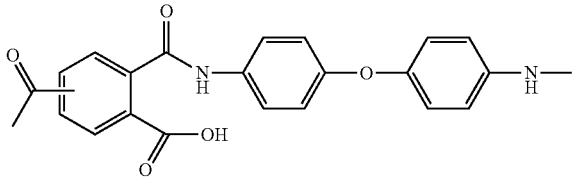

wherein the attachment of the two amide groups to the aromatic ring as shown in (XV) will be understood to represent the 1,3 and the 1,4 polyamide-amic acid configurations; and (R1b-3)

(XVI)

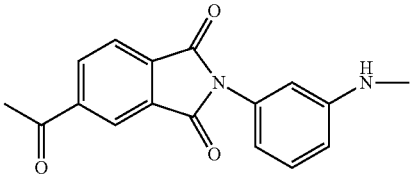

and/or the corresponding amide-amic acid containing recurring unit:

(XVII)

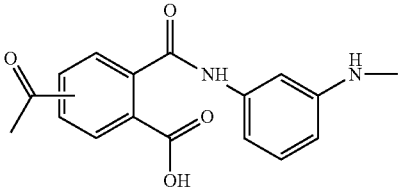

wherein the attachment of the two amide groups to the aromatic ring as shown in (XVII) will be understood to represent the 1,3 and the 1,4 polyamide-amic acid configurations.

Recurring units (R1b) are preferably a mix of recurring units (R1b-2) and (R1b-3). Polyamide-imides essentially all, if not all, the recurring units are recurring units complying with this criterion are commercialized by Solvay Advanced Polymers as TORLON®polyamide-imides.

The aromatic polyamide-imide can be notably manufactured by a process including the polycondensation reaction between (i) at least one acid monomer chosen from trimellitic anhydride and trimellitic anhydride monoacid halides and (ii) at least one comonomer chosen from diamines and diisocyanates.

Among the trimellitic anhydride monoacid halides, trimellitic anhydride monoacid chloride is preferred.

The comonomer comprises preferably at least one aromatic ring. Besides, it comprises preferably at most two aromatic rings. More preferably, the comonomer is a diamine. Still more preferably, the diamine is chosen from the group consisting of 4,4'-diaminodiphenylmethane, 4,4'-diaminodiphenylether, m-phenylenediamine and mixtures thereof.

In a third embodiment, the aromatic polyimide (P1) is an aromatic polyetherimide. For the purpose of the present invention, an aromatic polyetherimide is intended to denote any polymer of which more than 50 wt. % of the recurring units (R1) comprise at least one aromatic ring, at least one imide group, as such and/or in its amic acid form, and at least one ether group [recurring units (R1c)].

Recurring units (R1-c) may optionally further comprise at least one amide group which is not included in the amic acid form of an imide group.

A first class of aromatic polyetherimides consists of those wherein the recurring units (R1) are chosen from:

(R1c-1)

formula (XVIII)

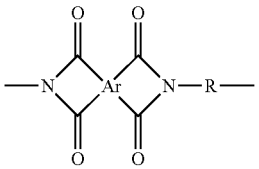

and/or formula (XIX)

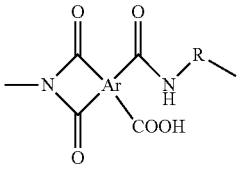

and/or formula (XX)

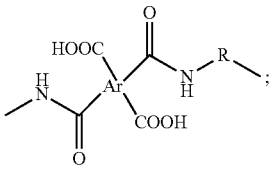

and (R1c-2)

(XXI)

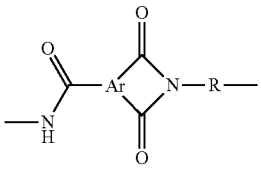

(imide form)

and/or (XXII)

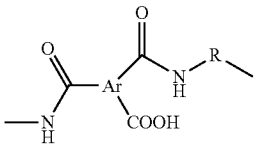

(amic acid form)

where:

Ar is:

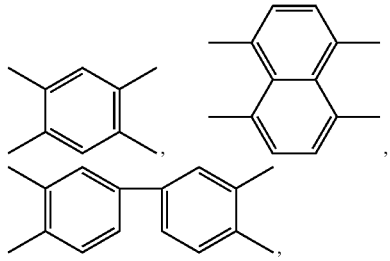

with X=

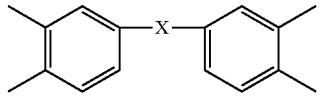

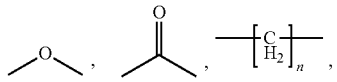

with n=1, 2, 3, 4 or 5;

R is:

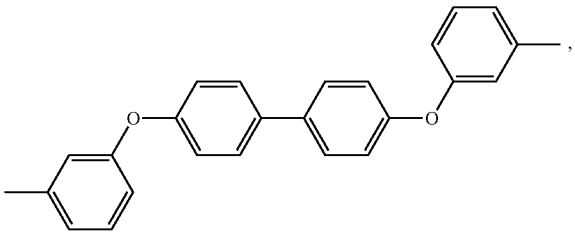

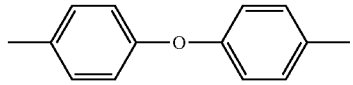

Examples of aromatic polyimides (P1) belonging to this first class of aromatic polyetherimides are those wherein the recurring units (R1) are of formula:

(XXIII)

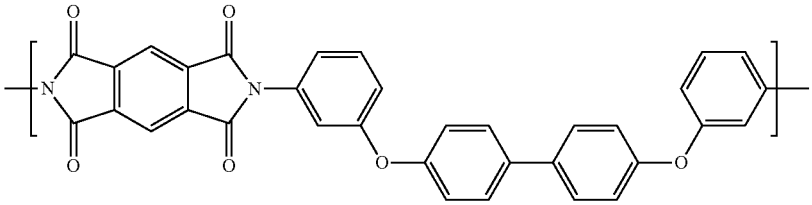

and/or its two corresponding amic acid forms [see formulae (XIX) and (XX) vs. the wholly imide form of formula (XVIII)].

Aromatic polyetherimides wherein essentially all, if not all, the recurring units are of formula (XOH), and/or their two corresponding amic acid forms, are notably commercially available from Mitsui as AURUM® polyimide.

A second class of aromatic polyetherimides consists of those wherein the recurring units (R1) are recurring units (R1c-4)

(XXXIII)

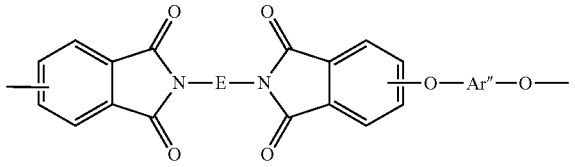

as such, and/or in their amic acid forms (XXXIV)

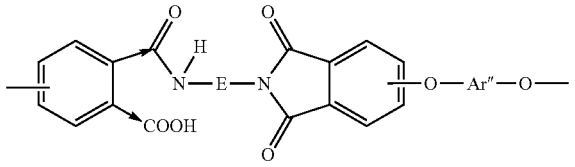

and/or (XXXV)

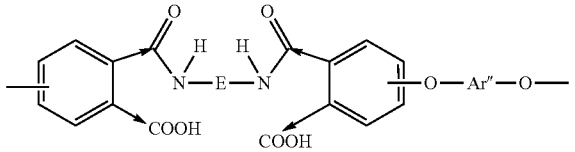

wherein:

the → denotes isomerism so that in any recurring unit the groups to which the arrows point may exist as shown or in an interchanged position;

E is chosen from:

(E-i)

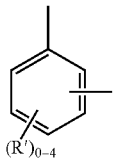

with the R' being, independently from each other, alkyl radicals comprising from 1 to 6 carbon atoms, aryls or halogens;

(E-ii)

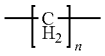

with n=integer from 1 to 6;

(E-iii)

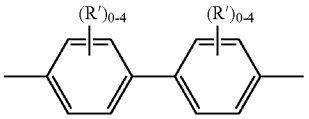

with the R' being, independently from each other, alkyl radicals comprising from 1 to 6 carbon atoms, aryls or halogens;

(E-iv)

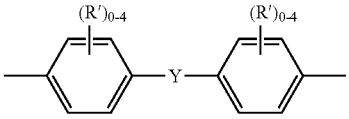

with the R' being, independently from each other, alkyl radicals comprising from 1 to 6 carbon atoms, aryls or halogens; and Y being chosen from:

(Y-i) alkylenes of 1 to 6 carbon atoms, in particular

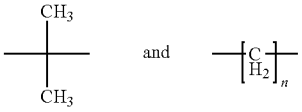

with n=integer from 1 to 6, (Y-ii) perfluoroalkylenes of 1 to 6 carbon atoms, in particular

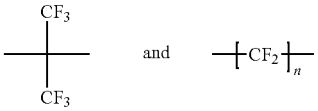

with n=integer from 1 to 6, (Y-iii) cycloalkylenes of 4 to 8 carbon atoms;

(Y-iv) alkylidenes of 1 to 6 carbon atoms;

(Y-v) cycloalkylidenes of 4 to 8 carbon atoms;

(Y-vi)

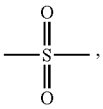

(Y-vii)

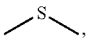

(Y-viii)

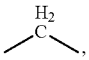

(Y-ix)

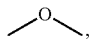

(Y-x)

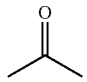

Ar" is selected from:

(Ar"-i) aromatic hydrocarbon radicals having from 6 to 20 carbon atoms and halogenated substituted thereof, or alkyl substituted derivatives thereof, wherein the alkyl substituting group contains 1 to 6 carbon atoms, such as:

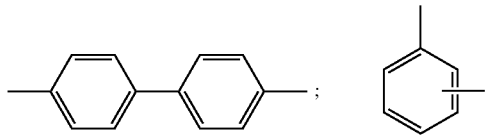

and halogenated substituted thereof, or alkyl substituted derivatives thereof, wherein the alkyl substituting group contains from 1 to 6 carbon atoms;

(Ar"-ii)

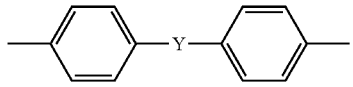

with Y being chosen from (Y-i), (Y-ii), (Y-iii), (Y-iv), (Y-v), (Y-vi), (Y-vii), (Y-viii), (Y-ix) and (Y-x), as above defined, (Ar"-iii) alkylene and cycloalkylene radicals having from 2 to 20 carbon atoms, and (Ar"-iv) terminated polydiorganosiloxanes.

The aromatic polyetherimides wherein the recurring units (R1) are recurring units (R1c-4) may be prepared by any of the methods well-known to those skilled in the art including the reaction of any aromatic bis(ether anhydride)s of the formula

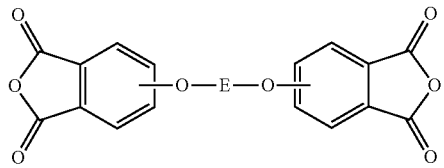

(XXXVI)

where E is as defined hereinbefore, with a diamino compound of the formula $$H_2N—Ar''—NH_2 \quad \text{(XXXVII)}$$

where Ar" is as defined hereinbefore. In general, the reactions can be advantageously carried out employing well-known solvents, e.g., o-dichlorobenzene, m-cresol/toluene, N,N-dimethylacetamide (DMA), etc., in which to effect interaction between the dianhydrides and diamines, at temperatures of from about 20° C. to about 250° C.

Alternatively, these polyetherimides can be prepared by melt polymerization of any dianhydrides of formula (XXXVI) with any diamino compound of formula (XXXVII) while heating the mixture of the ingredients at elevated temperatures with concurrent intermixing.

The aromatic bis(ether anhydride)s of formula (XXXVI) include, for example:

2,2-bis[4-(2,3-dicarboxyphenoxy)phenyl]propane dianhydride;

4,4'-bis(2,3-dicarboxyphenoxy)diphenyl ether dianhydride;

1,3-bis(2,3-dicarboxyphenoxy)benzene dianhydride;

4,4'-bis(2,3-dicarboxyphenoxy)diphenyl sulfide dianhydride;

1,4-bis(2,3-dicarboxyphenoxy)benzene dianhydride;

4,4'-bis(2,3-dicarboxyphenoxy)benzophenone dianhydride;

4,4'-bis(2,3-dicarboxyphenoxy)diphenyl sulfone dianhydride;

2,2-bis[4(3,4-dicarboxyphenoxy)phenyl]propane dianhydride;

4,4'-bis(3,4-dicarboxyphenoxy)diphenyl ether dianhydride;

4,4'-bis(3,4-dicarboxyphenoxy)diphenyl sulfide dianhydride;

1,3-bis(3,4-dicarboxyphenoxy)benzene dianhydride;

1,4-bis(3,4-dicarboxyphenoxy)benzene dianhydride;

4,4'-bis(3,4-dicarboxyphenoxy)benzophenone dianhydride;

4-(2,3-dicarboxyphenoxy)-4'-(3,4-dicarboxyphenoxy) diphenyl-2,2-propane dianhydride; etc. and mixtures of such dianhydrides.

The organic diamines of formula (XXXVII) include, for example, m-phenylenediamine, p-phenylenediamine, 2,2-bis (p-aminophenyl)propane, 4,4'-diaminodiphenyl-methane, 4,4'-diaminodiphenyl sulfide, 4,4'-diamino diphenyl sulfone, 4,4'-diaminodiphenyl ether, 1,5-diaminonaphthalene, 3,3'-dimethylbenzidine, 3,3'-dimethoxybenzidine, In the recurring units (R1c-4), E is preferably chosen from (E-i)

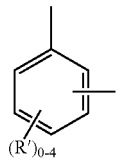

with the R' being, independently from each other, alkyl radicals comprising from 1 to 6 carbon atoms, aryls or halogens; more preferably, E is unsubstituted m-phenylene.

Besides, in the recurring units (R1c-4), Ar" is preferably chosen from (Ar"-ii)

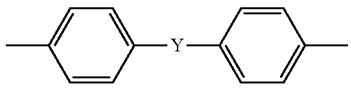

with Y being chosen from (Y-i), (Y-ii), (Y-iii), (Y-iv), (Y-v), (Y-vi), (Y-vii), (Y-viii), (Y-ix) and (Y-x), as above defined.

More preferably, Ar" is

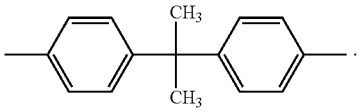

Good results were obtained when the recurring units (R1c-4) were recurring units of formula (XXXVIII) as such, in imide form, and/or in amic acid forms [formulae (XXXIX) and (XL)]:

(XXXVIII)

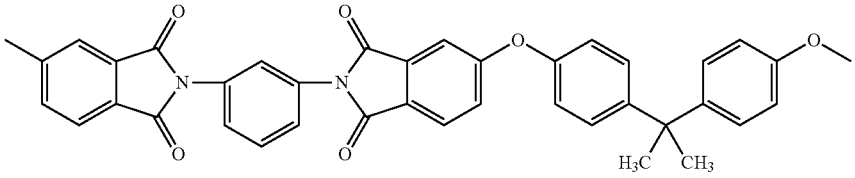

and/or (XXXIX)

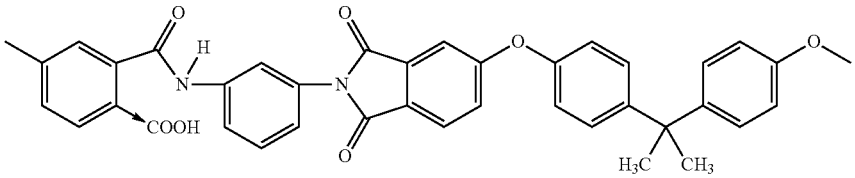

and/or (XL)

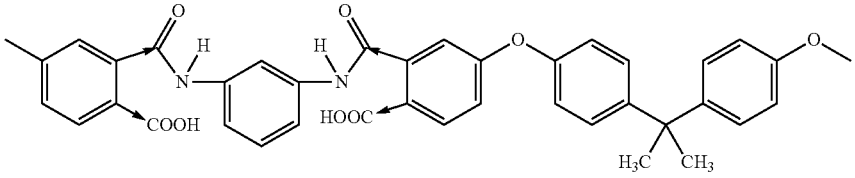

wherein in formulae (XXXIX) and (XL) the → denotes isomerism so that in any recurring unit the groups to which the arrows point may exist as shown or in an interchanged position.

Aromatic polyetherimides of which essentially all, if not all, the recurring units are of formula (XXXVIII), and/or their corresponding amic acid forms (XXXIX) and/or (XL) are commercially available from General Electric, now SABIC, as ULTEM® polyetherimides.

Good results may be also obtained when the recurring units (R1c-4) are recurring units of formula (XLI) as such, in imide form, and/or in amic acid forms [formulae (XLII) and (XLIII)], as represented below:

(XLI)

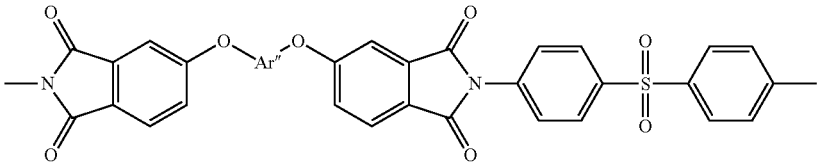

(XLII)

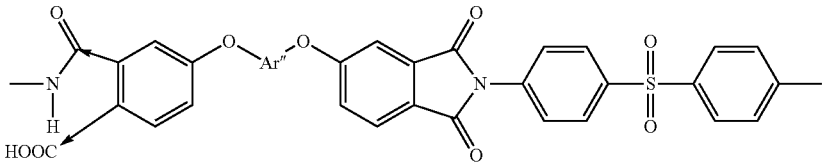

-continued (XLIII)

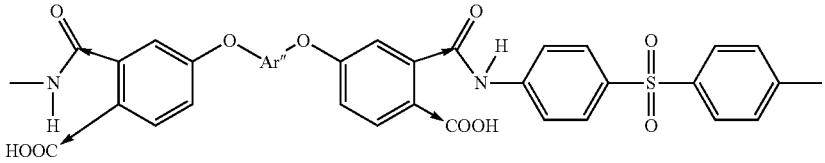

wherein:

(XLII) and (XLIII) are the amic acid forms corresponding to the imide form (XLI);

the → denotes isomerism so that in any recurring unit the groups to which the arrows point may exist as shown or in an interchanged position;

Ar" is chosen among the following structures:

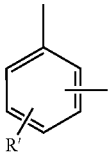

with the linking groups being in ortho, meta or para position and R' being a hydrogen atom or an alkyl radical comprising from 1 to 6 carbon atoms,

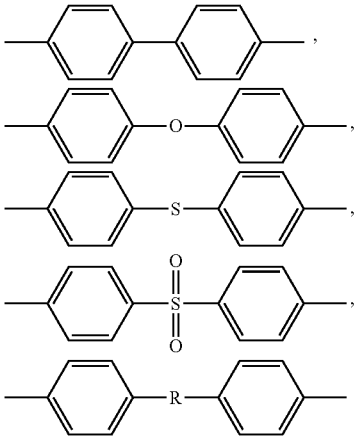

with R being an aliphatic divalent group of up to 6 carbon atoms, such as methylene, ethylene, isopropylene and the like, and mixtures thereof.

Aromatic polyetherimides of which essentially all, if not all, the recurring units are of formula (XLI), and/or their corresponding amic acid forms (XLII) and/or (XLII) are commercially available from General Electric, now SABIC, as EXTEM® polyetherimides.

Preferably more than 75 wt. % and more preferably more than 90 wt. % of the recurring units of the aromatic polyimide (P1) are recurring units (R1). Still more preferably, essentially all, if not all, the recurring units of the aromatic polyimide (P1) are recurring units (R1).

The blend (B) can comprise one and only one aromatic polyimide (P1). Alternatively, it can comprise two, three, or even more than three aromatic polyimides (P1).

In the process of the present invention, a solution of the polymer in at least one halogen-free organic solvent (S1) for the polymer is employed. As long as the organic solvent (S1) is halogen-free there is no particular limitation to the solvent. In general the organic solvent (S1) is however a polar aprotic solvent.

In a preferred process according to the present invention, the solvent (S1) and/or the solvent (S2) is selected from the group consisting of dipolar aprotic solvents, particularly preferred from the group consisting of DMF, DMA, NMP and mixtures thereof.

The terms "solvent for the polymer" and "soluble" generally imply that the polymer is soluble to an extent of at least 97%, preferably at least 99% at an applied temperature. In contrast, the terms "insoluble" generally implies that the polymer is soluble to an extent of at most 3%, preferably at most 1% at an applied temperature.

The applied temperature may vary considerably. In step (aa) the solution of the polymer is in general provided at a temperature of from −10° C. to 150° C., preferably 20° C. to 80° C.

The solution can be provided in step (aa) in a suitable storage device which is not limited as long as it allows the storage of the polymer solution and the pushing of the solution through a nozzle. A suitable storage device may be an extruder, preferably equipped with a metered pump to allow in step (bb) that a desired specific amount of solution can be pushed through a nozzle.

The term "nozzle" as used herein is to be interpreted broadly as a device with at least one opening through which a polymer solution might be pushed in order to yield a fiber or foil. In fact, there is no particular limitation to the shape of the nozzle and the number and shape of the openings which the nozzle contains, as long as the nozzle allows manufacturing the desired foil or fiber.

For the manufacture of fibers it is preferred to use a spinneret. A spinneret is in general a small metal plate, thimble, or cap with one or more fine holes through which a liquid mass containing the material to be spun (polymer melt or solution) is forced for spinning filaments.

In the process of the present invention, in step (cc), the solution is introduced into a coagulation bath comprising (cc1) at least one liquid (L1) in which the polymer is insoluble, and optionally (cc2) at least one organic solvent (S2), in which the polymer is soluble, identical to or different from the organic solvent (S1), to form a fiber or foil.

The liquid (L1) is not specifically limited as long as the polymer is insoluble in it. Preferably, (L1) is halogen-free.

In a preferred embodiment of the process of the present invention, the at least one liquid (L1) is water and/or a $C_1$ to $C_{15}$ mono- or polyhydric alcohol. Non-limiting examples for the $C_1$ to $C_{15}$ mono- or polyhydric alcohol are methanol, ethanol, 1,2-ethanediol, propanol, 1,2-propanediol, glycerin, n-butanol, 2-butanol, $HO—(CHR^1—O—CHR^2)_n—OH$, wherein $R^1$ and $R^2$ are independently from each other H or $CH_3$ and n is from 1 to 5, etc. The $C_1$ to $C_{15}$ mono- or polyhydric alcohol is preferably a $C_1$ to $C_{10}$ mono- or polyhydric alcohol.

The at least one organic solvent (S2) is identical or different from the organic solvent (S1). Preferably, the solvent (S2) is identical to the at least one solvent (S1). More, preferably, all organic solvents (S2) used are identical to all solvents (S1) used.

In general, neither liquid (L1) nor solvents (S1) and/or (S2) do react with the polymer used in the present invention.

The temperature of the coagulation bath is in general in the range of from −10 to 100° C., preferably in the range of from 20 to 60° C.

In one embodiment of the present invention, an airgap of from 0.2 cm to 20 cm, preferably of from 0.5 cm to 10 cm is used between the nozzle and the coagulation bath. The gas in the airgap may vary broadly. Preferably, air or nitrogen is used. The temperature of the gas is in general in the range of from 10 to 50° C., preferably 20 to 35° C.

In another embodiment of this invention, the polymer solution enters the coagulation bath directly so that there is no air gap, for example, the spinneret is submerged in the coagulation bath.

In a particularly preferred embodiment of the process of the present invention, the process further comprises a step (dd) of drawing the fiber or foil obtained in step (cc). Preferably, the fiber or foil obtained in step (cc) is drawn by 5% to 300%.

This drawing occurs after the solution had been pushed through a nozzle between a first and a second roll and is thus different from jet drawing which is established by setting a specific ratio of the speed of the solution coming from the nozzle to the rotation speed of the first roll.

In the case of a foil, drawing can be performed in the longitudinal and/or in the transverse direction. Preferably, drawing of a foil is performed in the longitudinal direction, i.e. in the direction of the flow of the solution through the nozzle.

In addition to the polymer and the solvent, the spinning solution may contain other substances, such as those additives which are conventionally used in the wet spinning of polymer fibers, for example colouring agents, pigments, heat stabilizers, light stabilizers, dye affinity aids, softening agents and spinning aids.

In a second aspect, the invention is directed to a fiber or foil, comprising at least one optionally functionalized polymer with a high $T_g$ selected from the group consisting of poly(aryl ether sulfone) (PAES), poly(aryl ether ketone) (PAEK) and aromatic polyimide, obtainable by a process comprising the steps of (aa) providing a solution comprising at least 45 wt. %, based upon the weight of the solution, of the polymer, and at least 20 wt. %, based upon the weight of the solution, of at least one halogen-free organic solvent (S1) for the polymer;

(bb) pushing the solution through a nozzle; and (cc) introducing the solution into a coagulation bath comprising (cc1) at least one liquid (L1) in which the polymer is insoluble, and optionally (cc2) at least one organic solvent (S2) for the polymer, identical to or different from the organic solvent (S1), to form a fiber or foil.

Preferably, the at least one liquid (L1) is water and/or a $C_1$ to $C_{15}$ mono- or polyhydric alcohol. Water and/or a $C_1$ to $C_{10}$ mono- or polyhydric alcohol are preferred.

In a third aspect, the present invention is directed to a fiber or foil, comprising at least one optionally functionalized polymer with a high $T_g$ selected from the group consisting of poly(aryl ether sulfone) (PAES), poly(aryl ether ketone) (PAEK) and aromatic polyimide, comprising a porous core, wherein porosity, as defined as the ratio between the volume of void-space $V_V$ and the total (bulk) volume $V_B$ of the fibers, including the solid and void component, is at least 5%; and wherein the fiber or foil has (a) a tenacity ≥6 cN/tex, and/or (b) an elongation at break ≥150%.

In the fiber or foil of the third aspect, the porosity Φ may be of at least 10%, at least 20%, at least 30% or at least 40%; it may also be of at most 60%, at most 50%, at most 40%, at most 30% or at most 20%. In a preferred embodiment of the third aspect, the porosity Φ is preferably of at least 7%. In a particular preferred embodiment of the third aspect, the porosity Φ is in the range of from 7% to 60%, and even more preferably in the range of from 7% to 50%.

The porosity Φ of a fiber (and in a corresponding manner the porosity Φ of a foil) can be estimated from the weight and diameter of the fiber as follows. Fiber tex is a commonly used term to express linear density and is equal to the weight in grams of 1 kilometer of yarn. In a nonporous fiber, the volume of the fiber multiplied by the density of the polymer will yield the tex of the fiber. The volume of the fiber is the length of the fiber times the cross sectional area. In particular, the volume of 1000 meters of yarn is equal to:

$V$ (in $cm^3$)$=100{,}000\pi r^2$, with the fiber radius r expressed in cm.

As a result, $Tex=\rho\ 100{,}000\pi r^2$, where ρ is polymer specific gravity in g/cc.

and since 0.1 decitex=1 Tex,

Fiber dtex (decitex)$=\rho 1{,}000{,}000\pi r^2$, where ρ is polymer specific gravity in g/cc.

In the case of poly(ethersulfone), the polymer has a specific gravity of 1.37 g/cc. Thus, if the diameter of the fiber is for example 18.9 μm, the fiber dtex can be calculated to be 3.84 in theory (theoretical dtex). If the experimental data indicate however that the fiber has a dtex of 2.2 (actual dtex), the porosity can be calculated from the following equation:

$$\text{Porosity } \Phi \text{ (Void Fraction)} = V_V/V_B = 1-(\text{actual dtex}/\text{theoretical dtex}).$$

In the aforementioned case, the porosity is 0.428, or 42.8%.

Such a calculation is verified by considering the case of a melt spun poly(ethersulfone) fiber, having no porosity, as determined by microscopy. This fiber was established by microscopy as having a diameter of 15 microns. Such a fiber was measured to have a dtex of 2.43. Using the above formula, the predicted dtex is 2.42, identical to the predicted diameter.

In a preferred embodiment the fiber or foil according to the third aspect has a strength of ≥7 cN/tex, more preferably ≥10 cN/tex and most preferably of ≥13 cN/tex.

In another preferred embodiment the fiber or foil according to the third aspect has an elongation at break of ≥200%.

The polymer with a high $T_g$ in the fiber or foil may be unfunctionalized or functionalized. Preferably, the polymer with a high $T_g$ in the fiber or foil is functionalized with one or more functional groups, in particular with one or more hydroxyl and/or amine groups, more particularly hydroxyl groups. The term "functionalized" often refers to the reactive nature of the polymer. In particular, a polymer is considered reactive if, when treated further under appropriate conditions, the polymer reacts further. The usually reactive nature of functionalized polymers makes it difficult to prepare fibers from such materials via melt extrusion. When melting such polymers it is most common to cause the reactive groups of the polymer to react, thereby producing a fiber with fewer, or zero reactive groups. As a result, such a fiber is not a fiber which contains functionalized groups.

In the specific case of polycondensation polymers prepared using nucleophilic reaction chemistry, the functionality of the polymer generally exists in the form of endgroups. The relationship between endgroup concentration and polymer molecular weight for polycondensation polymers is well known, as determined by Paul J. Flory and others (in particular Stockmeyer), and leads to the following simple equations:

Mn (number average molecular weight)=2,000,000/(total endgroup concentration), and Mw (weight average molecular weight)=4,000,000/(total endgroup concentration), where the total endgroup concentration is measured in units of molar microequivalents per gram of polymer. Therefore, if one is targeting a particular polymer molecular weight, the total endgroup concentration is fixed. It is also easily noted that the molecular weight and total endgroup concentration are inversely correlated so that the only way to increase endgroup concentration is to produce lower molecular weight.

In the specific case of poly(ethersulfone) prepared using 4,4-dichlorodiphenyl sulfone and Bisphenol S, the endgroups of the polymers are either Chlorine or Hydroxyl. Since the hydroxyl endgroups are the more reactive of the endgroups, to produce a material with residual reactivity, the reaction is generally operated in such a manner as to produce an excess of OH groups. The methods for achieving this are well known to those skilled in the art and include conducting the reaction with an excess of the Bisphenol S monomer.

In some cases, it is desired to produce a material with functionalization beyond that which is capable from standard polycondensation chemistry, as described above. In this case, it is common for molecules which contain functionality to be "grafted" or reacted onto the backbone of a polymer. This is also a method used to produce functionality for polymers which do not have reactive groups at their polymer ends. Such technology is well known to those skilled in the art.

The fiber or foil of the third aspect is preferably obtainable by the process of the first aspect of the present invention. Preferred embodiments of the process of the first embodiment are equally applicable.

Finally, the present invention is directed in a fourth aspect to a fiber or foil, comprising at least one optionally functionalized polymer with a high $T_g$ selected from the group consisting of poly(aryl ether sulfone) (PAES), poly(aryl ether ketone) (PAEK) and aromatic polyimide, having a tenacity of ≥12 CN/tex and/or an elongation at break ≥60%.

Preferably, the fiber or foil of the fourth aspect has a modulus of ≥100 CN/tex.

The fineness of fiber is measured according to DIN 53812 as weight/length. The tenacity, modulus and breaking elongation as used herein is measured according to DIN 53816.

In a preferred embodiment, the fiber or foil of the fourth aspect has a tenacity (tenacity) of >12 CN/tex, more preferably of >13 cN/tex, and most preferably of >15 cN/tex, and an elongation at break of ≤180%.

In an alternative embodiment, the fiber or foil of the fourth aspect has a tenacity of from 4.8 to 9.5 CN/tex and an elongation at break of ≥100%.

The fiber or foil of the fourth aspect is preferably obtained by the process of the first aspect of the present invention. Preferred embodiments of the process of the first embodiment are equally applicable. Moreover, the fiber or foil of the fourth aspect has preferably the porosity features of the third aspect of the present invention.

In a preferred embodiment of the present invention, the fiber or foil according to the first to fourth aspects of the present invention comprises a polymer, comprising polymer chains that are functionalized at their ends by an amine or hydroxy group.

The fiber of the present invention has usually a number average diameter $d_{fib}$ of from 2 to 5000 μm, preferably of from 5 to 1000 μm, more preferably of from 10 to 250 μm. Most preferably, the fiber of the present invention has a number average diameter (thickness) $d_{fib}$ of from 5 to 100 μm.

The optionally functionalized polymer is preferably an optionally functionalized poly(aryl ether sulfone); besides, it is preferably functionalized, e.g. it can be amine or hydroxy-terminated.

Filaments can be used as such or as a bundle of multiple filaments.

Preferably, the weight average molecular weight of the polymer is in the range of from 5,000 to 120,000, more preferably in the range of from 10,000 to 100,000. The weight average molecular weight of the polymer is in general determined by gel permeation chromatography using preferably polystyrene standards.

The fibers according to the present invention can show significantly improved mechanical properties. Specific combinations of tenacity and elongation at break can be achieved easily.

Moreover, the customary additives for the above outlined polymers known to the person skilled in the art can be used accordingly.

The invention will be better understood by way of consideration of the following examples, which are provided by way of illustration and not in limitation thereof. In the examples, all parts and percentages are by weight unless otherwise specified.

EXAMPLES

Manufacture of Polymer

As an example for a synthesis of a polymer to be used in accordance with the present invention, the synthesis of particularly suitable poly(aryl ether sulfones) is described according to the following general procedure which is preferably used on a laboratory scale.

Polymerization Process

A 500 ml, 4-neck round bottom flask is equipped through its center neck with an overhead stirrer attached to a stainless steel paddle. A Claisen adapter fitted with a Dean-Stark trap and a water-cooled condenser is attached to a side neck, and a thermocouple thermometer attached to a temperature controller is inserted into the reactor through the Claisen adapter. A gas inlet tube and a stopper are placed in the other necks of the round bottom flask. The reactor is placed in an oil bath fitted with heaters connected to the temperature controller.

Bisphenol S, 127.64 pbw (parts by weight), 4,4'-dichlorodiphenyl sulfone (143.58 pbw), anhydrous potassium carbonate (70.49 pbw), anhydrous sulfolane (541.94 pbw) and anhydrous chlorobenzene (77.42 pbw) are charged to the reactor.

The agitator is started to 300 rpm and the reactor is degassed by evacuating using a vacuum pump and then filling with nitrogen. The degassing operation is repeated two more times, and a steady stream of nitrogen through the reactor solution is started. Heating is initiated and the stirring speed is increased to 400 rpm, taking care not to splash the reaction solution above the heated zone of the reactor wall. As the temperature of the reaction mixture increases, chlorobenzene, along with the water formed as a reaction byproduct, distills as an azeotrope and is collected in the Dean-Stark trap; the collected distillate is not returned to the reaction flask. When the viscosity starts to increase, the agitator speed is increased to 500 rpm.

The predetermined reaction temperature, typically in the range of 200-240° C., will generally be attained within about 50 to 60 minutes after initiating the heating cycle, and will be maintained for the time needed to reach the target molecular weight, typically 15 to 60 minutes. Still longer heating periods may be required for particular combinations of monomers and reactants and when other reactant stoichiometries are used. Those skilled in polycondensation process engineering will be familiar with the variety of methods widely employed in laboratory and plant operations for following the progress of a polymerization reaction. For example, the solution viscosity of the reaction mass increases as the polymerization proceeds, thereby increasing the load on the agitator motor. The progress of the polymerization reaction may thus be followed by monitoring the corresponding increase in load on the agitator motor circuit.

Upon reaching the desired molecular weight, the polymerization process is quenched by adding a mixture of sulfolane (88 pbw) and chlorobenzene (431 pbw) slowly from an addition funnel to cool the reaction mixture, typically to a temperature in the range of about 160-180° C. to reduce the viscosity of the reaction mass for filtering. The diluted polymer solution now comprises 232.2 pbw (theoretical yield) of the polymer dissolved in a mixture of chlorobenzene and sulfolane, at a concentration of approximately 16 wt %, together with suspended byproduct salts. After cooling to a temperature in the range of 100-130° C., the solution is filtered to remove the byproduct salts. Filtration may be conveniently accomplished using a 2 micron filter medium in a pressure filter funnel under 10-20 psig nitrogen pressure.

After salt removal, the polymer is coagulated and recovered by slowly adding 100 pbw of the cooled solution to 500 pbw of a 70:30 mixture of methanol and water in a blender under high speed agitation. The precipitate is collected by filtration, returned to the blender, and given successive washings using 400 pbw methanol, 400 pbw deionized water and finally 400 pbw methanol. The washed precipitate is collected by filtration and dried in a vacuum oven (60 mm) at 120° C. with an air-bleed.

Monomer stoichiometry and potassium carbonate/bisphenol S ratio may vary around a 1:1 ratio as desired, for example, as an aid in controlling the final molecular weight and endgroup ratio of the product. In this example, the polymerization is conducted using a slight excess of bisphenol S (2%) and the potassium carbonate to bisphenol S ratio is 1:1. Those skilled in the art will recognize that the monomer mole ratio may also be adjusted as desired to achieve other levels of endgroups, and that molecular weight may be further controlled by extending or reducing the reaction hold time or by use of higher or lower reaction temperatures. Poly(ether sulfones) having a reduced viscosity generally in the range of from 0.3 to 1.0 dl/g may be prepared in this manner. In this particular example, a poly(ether sulfone) with a reduced viscosity of 0.39 dl/g was produced. This material was found to have MW, as measured by Gel Permeation Chromatography (GPC), of 30040. Hydroxyl endgroup concentrations, as measured by titration, were 101 μeq/g and chlorine endgroup concentration was determined to be 33 μeq/g.

Preparation of Poly(Biphenyl Ether Sulfones) on a Pilot Scale and in production equipment may be accomplished substantially by the polymerization process outlined for laboratory use. However, as will be understood by those skilled in the process engineering arts, heating times, agitation and polymer recovery methods will necessarily be varied to accommodate the requirements of the particular large scale process equipment selected for conducting the polymerization.

Spinning Examples

In the following spinning examples, a poly(ether sulfone) (PES) with the chemical structure (E)

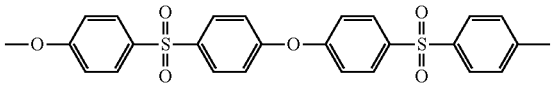

having a weight average molecular weight of 40,200, as measured by Gel Permeation Chromatography (GPC) measured at room temperature using polystyrene standards was used. Hydroxyl end-group concentrations, as measured by titration, was 91 μeq/g (micro equivalents per gram) and chlorine endgroup concentration was determined to be 10 μeq/g. Per Flory & Stockmeyer's polycondensation theory, this endgroups concentration suggests a weight average molecular weight of 39601 (4,000,000/101), quite consistent with the value measured by GPC. It is further noted that this material, by design, has a dominance of the reactive OH endgroups, by design. It is in general of importance that these OH endgroups remain essentially undestroyed in the fiber production process.

It can also be understood, by those skilled in the art, that the number of reactive hydroxyl endgroups can be increased by producing a lower molecular weight polymer. Similarly, a higher molecular weight polymer would have fewer endgroups, in a manner consistent with the well-known Flory/Stockmeyer relationship which specifies that weight average molecular weight is determined from the equation Mw=4,000,000/(total endgroups). Since the only endgroups in this polymer are Cl and OH, the number of OH endgroups is inversely proportional to the weight average molecular weight.

The following general description relates to a preferred method for the production of PES fibers. Herein, a solution of the polymer in an organic solvent S1 is prepared (in the following to be referred to as "spinning dope") and pushed through a spinneret by means of extrusion. More specific data regarding the Examples performed are indicated in the Tables.

Extrusion

The spinning dope is stored in a thermally stabilized vessel at a temperature of 20-110° C. A pressure of about 2 bar is applied to the spinning dope to transport it to the metering pump (V=6 $cm^3$). The dope is filtered through a filter element with about 10 μm mesh size and pushed through a spinning pipe (spinneret) into the coagulation bath, either directly or through an air gap (0.5-10 cm). The spinnerets used had from 1 to 500 holes with perimeters from 40-150 μm. A typical size was 100 holes with each 60 μm perimeter. The means to push the dope through the spinneret are not particularly limited. It is however preferred to use an extruder combined with a melt pump. The injection speed $V_{die}$[m/min] of the spinning dope varies as indicated in the spinning examples.

Coagulation Bath

The coagulation bath length varies from 20-120 cm and the coagulation temperature T varies from 10-90° C. Pure water, Water/DMF 50:50% mixtures and pure isopropanol were used as coagulants.

After the coagulation bath, the fiber is taken up by a first roller which rotates with a spinning speed V1 of from 6 to 40 m/min yielding jet draw ratios from −80% up to 150%.

Drawing

From the first roller, the fiber moves to a second roller (Speed V2 [m/min]). The space between the first and the second roller is the drawing section. The extent of drawing in the Examples varies from 0-169% which is adjusted by different V1/V2 ratios. The drawing is performed in air or in a heated water bath (80 cm length) at 95° C.

(Examples C1 to C5) and 50% (Examples 1 and 2), and processed into various coagulation solvents as shown in Table 1. The airgap was filled with air. The temperature of the coagulation bath was either room temperature (RT) or 60° C., as noted in Table 1. Examples C1 through C5 demonstrate that, although variations in coagulation bath composition and polymer composition were attempted, the fibers were weak with low elongation at break which is a clear indicator of the brittle nature of the material. The benefit of 50% polymer concentration is demonstrated by the data for Examples 1 to 3 in Table 1 which demonstrated that fibers with elongation at break in excess of 150% were obtained, a dramatic improvement. "14BD" is the abbreviation of butane-1,4-diol.

TABLE 1

| Example | C1 | C2 | C3 | C4 | C5 | 1 | 2 | 3 |
|---|---|---|---|---|---|---|---|---|
| Polymer concentration in spinning solution [%] | 27.5% | 27.5% | 27.5% | 40.0% | 40.0% | 50.0% | 50.0 | 50.0 |
| Solution temperature [° C.] | RT | 60 | 60 | RT | RT | RT | RT | 70 |
| Air gap [cm] | 1 | 1 | 1 | 1 | 1 | 10 | 10 | None |
| Holes in spinneret | 100 | 100 | 100 | 100 | 100 | 28 | 28 | 100 |
| Hole diameter in spinneret [μm] | 60 | 50 | 50 | 50 | 50 | 80 | 80 | 60 |
| Coagulation bath [%/%] | $H_2O$/DMA (50/50) | $H_2O$/DMA (30/70) | $H_2O$/14BD (20/80) | $H_2O$/DMA (40/60) | $H_2O$/DMA (40/60) | $H_2O$ | Isopropanol | 1,2-propanediol |
| Melt pump [cc/min] | 1.95 | 2.61 | 3 | 2.37 | 2.37 | 1.86 | 1.86 | 3.72 |
| Speed $V_{die}$ [m/min] | 6.9 | 13.3 | 15.3 | 12.1 | 12.1 | 13.2 | 13.2 | 13.2 |
| Jet drawing ($V_1/V_{die}$-1) [%] | 45% | −24.8% | −34.6% | −17.2% | −17.2% | 51.3 | 127.0 | 105.2 |
| Speed $V_1$ [m/min] | 10 | 10 | 10 | 10 | 10 | 20 | 30 | 27 |
| Drawing ($V_2/V_1$-1) [%] | 100% | 100% | 100% | 50% | 0% | 0 | 0 | 0 |
| Speed $V_2$ [m/min] | 20 | 20 | 20 | 15 | 10 | 20 | 30 | 27 |
| Fineness of filament [Dtex] | 2.2 | 4.1 | 4.2 | 8.0 | 11.5 | 13.6 | 6.3 | 8.9 |
| Tenacity [cN/tex] | 4.2 | 3.2 | 5.7 | 4.5 | 3.6 | 7.4 | 4.9 | 7.1 |
| Elongation at break [%] | 6.6 | 4.3 | 24.3 | 16.5 | 44.9 | 247 | 176 | 219 |
| Measured fiber diameter $d_{fib}$ [in microns] | 18.9 | 42.7 | 45.8 | 46.7 | 51.4 | 42.9 | 33.1 | 32.2 |
| Porosity | 42.9% | 79.0% | 81.3% | 65.9% | 59.6% | 31.3% | 46.7% | 20.2% |

Washing Section

From the second roller the fiber moves to a third roller which rotates at a spinning speed V3 which is usually equal to V2. A washing bath, in general with pure water having 95° C., is situated between the second and the third roller.

The third roller is followed by a washing pot commonly named "godet" (closed box; pure water with a temperature of about 60° C.) having an effective washing length of about 10 m. The speed V4 of the godet is equal to speed V2.

Finishing

The washing godet is followed by a finishing bath where antistatic finish is applied (0.5% solution of phosphorous ester salts).

Drying/Winding

After the finishing treatment, the fiber (either monofilament or multifilament) is wound on a bobbin and dried under air or by passing through a heated funnel (160° C.-220° C., length 1.5-3 m) followed by a roller four (speed V5) before winding. V5 can be <V4 to allow for fiber shrinkage during drying (0.1-20%) or >V4 to minimize shrinkage during drying (1-30%). Such drying methods are well known to those skilled in the art.

Examples C1 to C5 (not According to the Invention)

Examples 1 and 2

The poly(ether sulfone) described above was dissolved into DMA at concentrations ranging from 27.5% to 40%

Examples 4 to 6

Examples 4 to 6 were conducted as Examples 1-3, except for the differences indicated in Table 2. Examples 4 to 6 demonstrate how strong fibers may be obtained. Especially strong fibers have a tenacity being >10 cN/tex. As will be obvious to those skilled in the art, when the fibers are brittle, as is the case for those produced from low polymer concentrations (examples C1-C5), the fibers cannot be drawn. Examples 4 to 6 demonstrate that strong fibers can be produced by the process of the present invention. While the examples show draws up to 167%, those skilled in the art realize that higher draw ratios can lead to improved properties. Of particular interest is the fact that high tenacity fiber was produced with high porosity, especially as noted by examples 4 and 6.

TABLE 2

| Examples | 4 | 5 | 6 |
|---|---|---|---|
| Polymer concentration in spinning solution [%] | 50.0 | 50.0 | 50.0 |
| Solution temperature [° C.] | RT | RT | RT |
| Number of holes in spinneret | 17 | 17 | 17 |
| Hole diameter in spinneret [μm] | 80 | 80 | 80 |
| Coagulation bath | $H_2O$ | $H_2O$ | $H_2O$ |
| Melt pump [cc/min] | 1.08 | 1.82 | 1.82 |

TABLE 2-continued

| Examples | 4 | 5 | 6 |
|---|---|---|---|
| Speed $V_{die}$ [m/min] | 12.6 | 21.3 | 21.3 |
| Jet drawing ($V_1/V_{die}$ − 1) [%] | 137.4 | −6.1 | −30 |
| Speed $V_1$ [m/min] | 30 | 20 | 15 |
| Drawing ($V_2/V_1$ − 1) [%] | 33 | 100 | 167 |
| $V_2$ [m/min] | 40 | 40 | 40 |
| Fineness of filament [Dtex] | 7.7 | 15.3 | 15.9 |
| Tenacity [cN/tex] | 13.1 | 14.7 | 18.2 |
| Elongation at break [%] | 163 | 80 | 44 |

TABLE 2-continued

| Examples | 4 | 5 | 6 |
|---|---|---|---|
| Measured fiber diameter $d_{fib}$ [in microns] | 32.9 | 39.1 | 57.5 |
| Porosity | 33.7% | 7.1% | 55.3% |

Examples 7 through 14

Experiments 7 through 14 were conducted as Examples 1 to 6, except for the differences indicated in Table 3. Examples 7 to 14 demonstrate that drawing contributes substantially to the formation of higher strength (tenacity) fibers. Additionally, the effects of drawing and jet drawing can be noted by considering the mechanical properties of obtained PES fibers.

The influence of the spinning conditions on fiber morphology is demonstrated in FIGS. 1 to 4 wherein electron microscopic micrographs for the fibers of specific Examples are shown.

FIG. 1 shows the micrograph for the fiber of Example C1 which is not according to the invention. It can be seen that large pores exist in the core and/or surface region of the fiber. The micrograph shown in FIG. 1 demonstrates a fiber structure consistent with a low elongation at break material.

Figure 1:
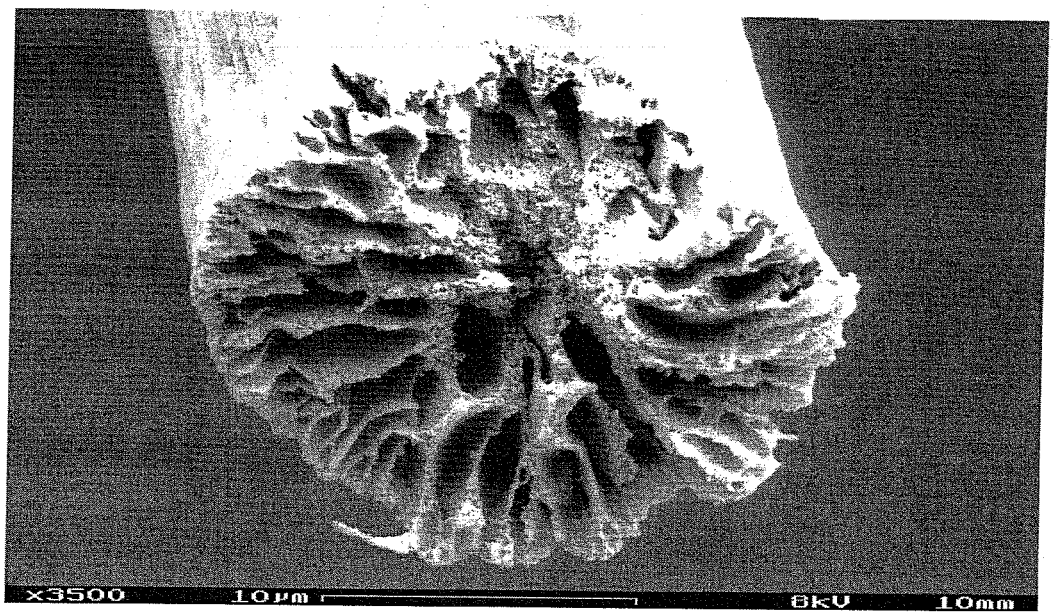
Figure 2:
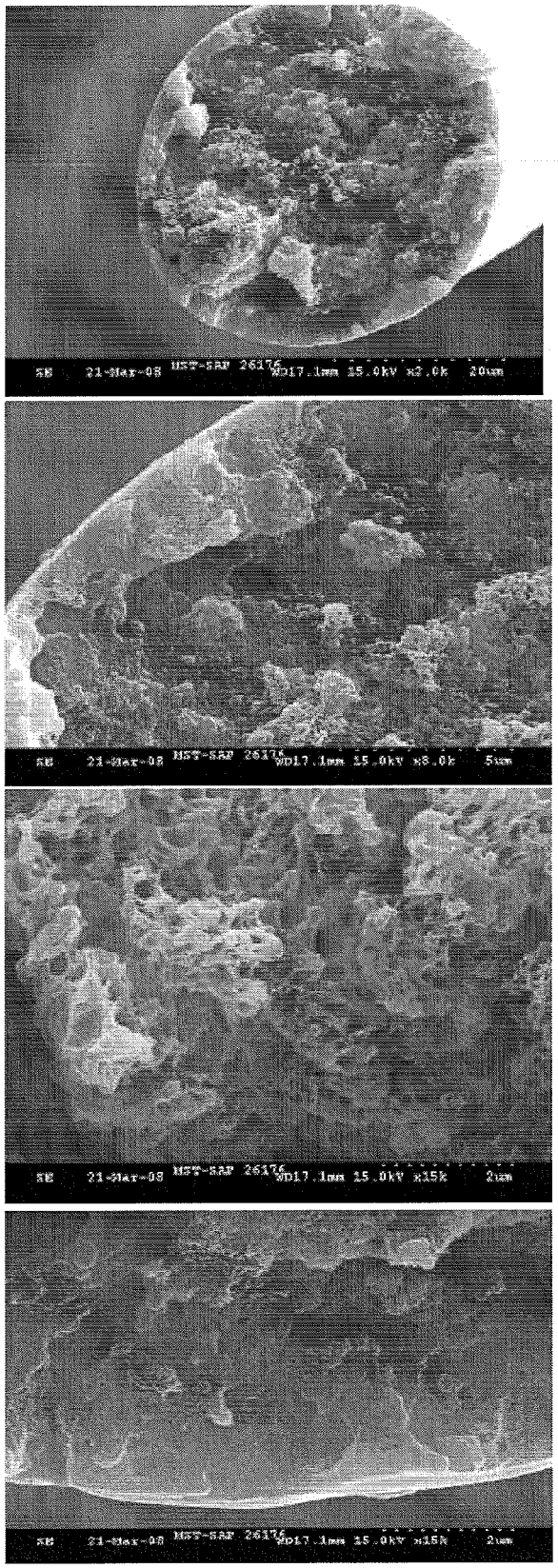
FIG. 2 shows electron micrographs of the fiber from Example 5 at various magnifications.
Figure 3:
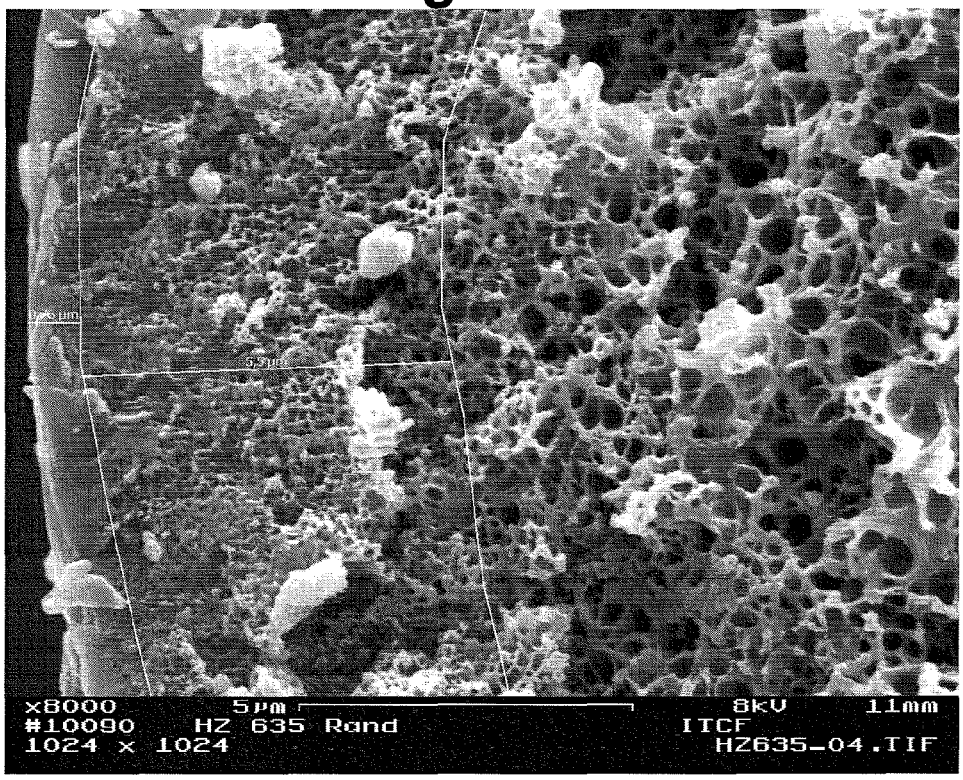
FIG. 3 shows two electron micrographs of a part of the fiber from Example 13 at various magnifications. It can be clearly seen that the cross-section of the fiber can be divided into a skin, an intermediate layer and a core part which differ in porosity.
Figure 3:
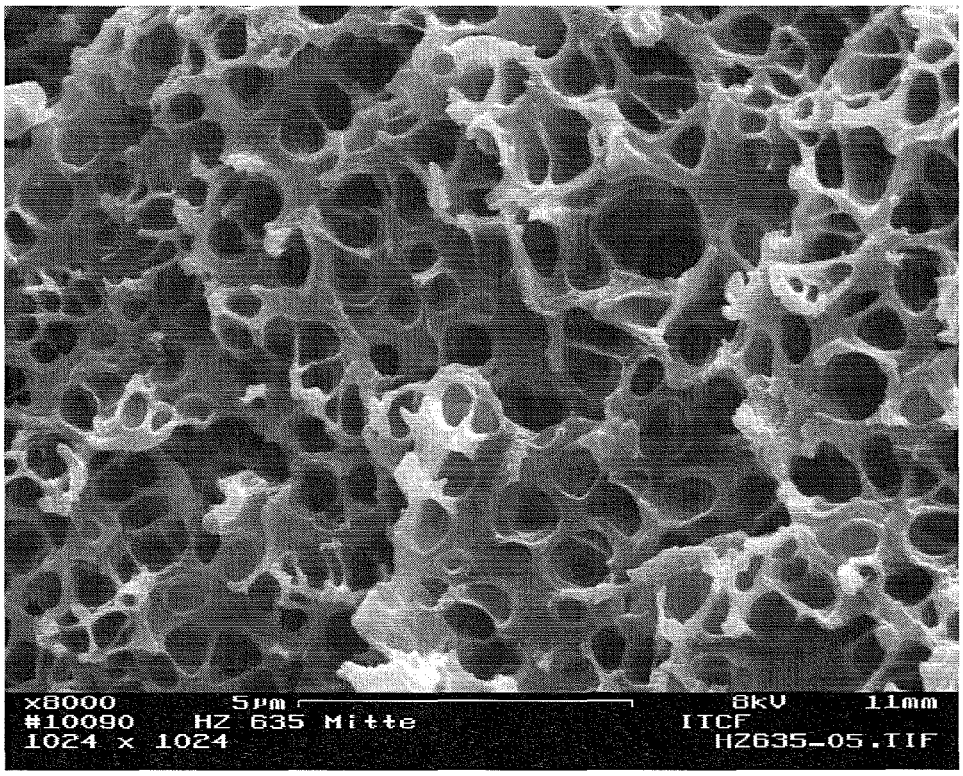
Figure 4:
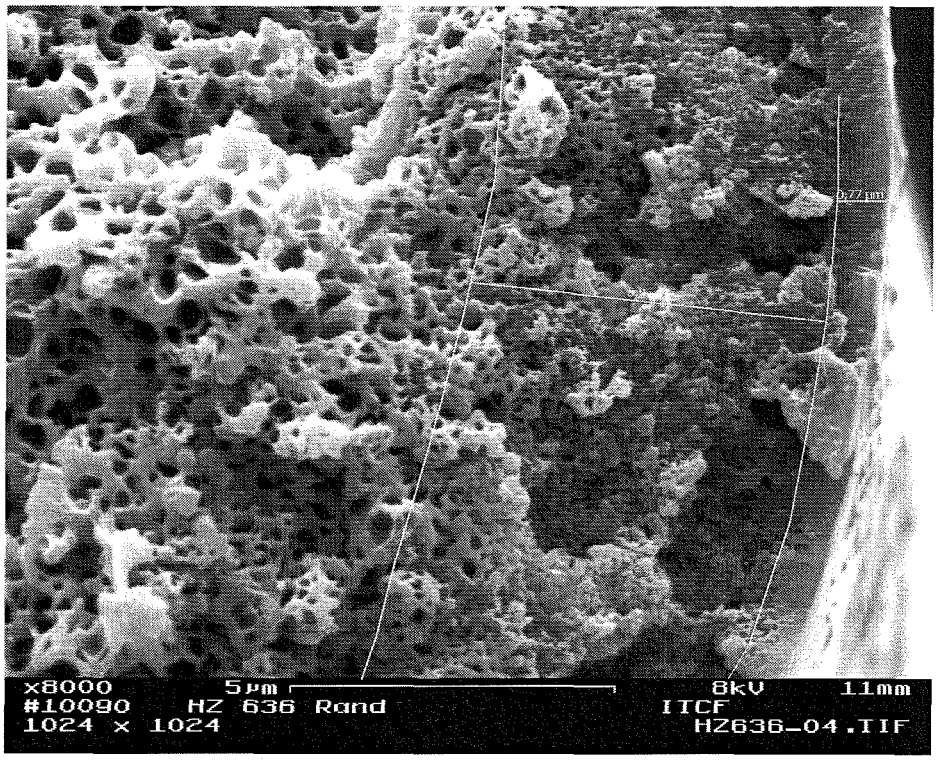
FIG. 4 shows two electron micrographs of a part of the fiber from Example 14 at various magnifications. It can be clearly seen that the cross-section of the fiber can be divided into a skin, an intermediate layer and a core part which differ in porosity.
Figure 4:
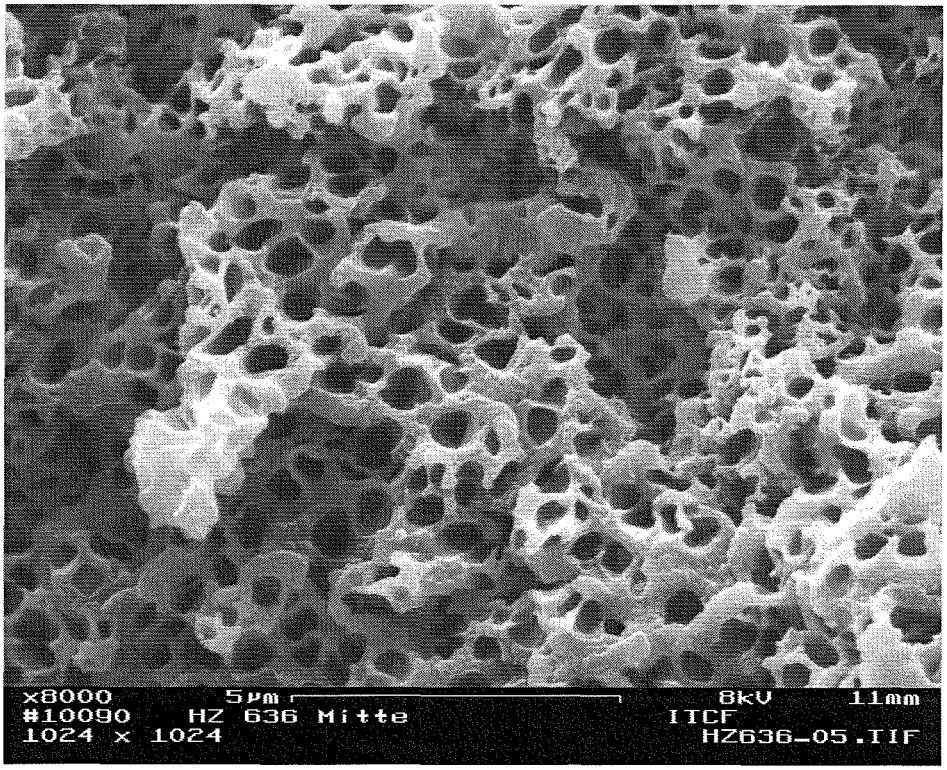

A comparison between FIG. 3 and FIG. 4 illustrates the effect of drawing on the morphology. The fiber of FIG. 3 was manufactured without drawing, while the fiber of FIG. 4 was manufactured by including a step of drawing by 100%. It can be clearly seen that the pores shown in FIG. 4 are smaller than the pores shown in FIG. 3.

It is noted that the fibers of Examples 1 to 14 had a porous core, wherein a porosity Φ, defined as the ratio between the volume of void-space $V_V$ and the total (bulk) volume $V_B$ of the fibers, including the solid and void component, is at least 5%.

TABLE 3

| Example | 7 | 8 | 9 | 10 | 11 | 12 | 13 | 14 |
|---|---|---|---|---|---|---|---|---|
| Polymer concentration in Spinning Solution [%] | 50.0% | 50.0% | 50% | 50.0% | 50.0% | 50.0% | 50.0% | 50.0% |
| Solution temperature [° C.] | 40 | 40 | 40 | 40 | 40 | 40 | 40 | 40 |
| Holes in spinneret | 32 | 32 | 32 | 32 | 32 | 32 | 32 | 32 |
| Hole diameter in spinneret [μm] | 100 | 100 | 100 | 100 | 100 | 100 | 100 | 100 |
| Coagulation bath | $H_2O$ | $H_2O$ | $H_2O$ | $H_2O$ | $H_2O$ | $H_2O$ | $H_2O$ | $H_2O$ |
| Melt pump [cc/min] | 1.4 | 1.4 | 1.4 | 1.4 | 1.4 | 1.4 | 1.4 | 1.4 |
| Speed $V_{die}$ [m/min] | 5.6 | 5.6 | 5.6 | 5.6 | 5.6 | 5.6 | 5.6 | 5.6 |
| Jet drawing ($V_1/V_{die}$-1) [%] | 17 | 17 | 17 | 17 | 155 | 155 | 76 | 76 |
| Drawing ($V_2/V_1$-1) [%] | 169 | 146 | 100 | 0 | 0 | 100 | 0 | 100 |
| Fineness of filament [Dtex] | 16.1 | 16.7 | 20.4 | 40.6 | 18.0 | 8.9 | 24.3 | 11.1 |
| Tenacity [cN/tex] | 15.5 | 9.3 | 7.1 | 5.4 | 5.6 | 13.1 | 5.4 | 12.9 |
| Elongation at break [%] | 50 | 110 | 114 | 189 | 223 | 89 | 184 | 90 |
| Measured fiber diameter $d_{fib}$ [in microns] | 46.7 | 41.4 | 48.0 | 85.0 | 52.3 | 35.9 | 56.7 | 45.2 |
| Porosity | 31.7% | 9.3% | 17.7% | 47.7% | 38.5% | 36.2% | 29.7% | 49.6% |

The invention claimed is:

1. A process for the manufacture of a fiber or foil comprising at least one optionally functionalized polymer with a high $T_g$ selected from the group consisting of poly(aryl ether sulfone) (PAES) comprising the steps of (aa) providing a solution comprising at least 50 wt. %, based upon the weight of the solution, of the polymer, and at least 20 wt. %, based upon the weight of the solution, of at least one halogen-free organic solvent (S1) for the polymer;

(bb) pushing the solution through a nozzle; and (cc) introducing the solution into a coagulation bath comprising (cc1) at least one liquid (L1) in which the polymer is insoluble, and optionally (cc2) at least one organic solvent (S2) for the polymer, identical to or different from the organic solvent (S1), to form a fiber or foil.

2. The process according to claim 1, wherein the at least one liquid (L1) is water and/or a $C_1$ to $C_{15}$ mono- or polyhydric alcohol.

3. The process according to claim 1, wherein the solvent (S1) and/or the solvent (S2) is selected from the group consisting of DMF (dimethylformamide), DMA (N,N-dimethylacetamide), NMP (N-methylpyrrolidone), and mixtures thereof.

4. The process according to claim 1, wherein the nozzle is submerged in the coagulation bath.

5. The process according to claim 1, further comprising a step (dd) of drawing the fiber or foil obtained in step (cc) by 5% to 300%.

6. A fiber or foil, comprising at least one optionally functionalized polymer with a high Tg selected from the group consisting of poly(aryl ether sulfone) (PAES) obtained by the process according to claim 1, wherein the polymer comprises polymer chains that are functionalized at their ends by an amine or hydroxy group.

7. A fiber comprising at least one optionally functionalized polymer with a high $T_g$ selected from the group consisting of poly(aryl ether sulfone) (PAES), comprising a porous core, wherein porosity Φ, defined as the ratio between the volume of void-space $V_V$ and the total (bulk) volume $V_B$ of the fibers, including the solid and void component, is at least 5%; and wherein the fiber or foil has (a) a tenacity ≥6 cN/tex, and/or (b) an elongation at break ≥150%.

8. The fiber according to claim 7, having an elongation at break ≥200%.

9. A fiber comprising at least one optionally functionalized polymer with a high $T_g$ selected from the group consisting of poly(aryl ether sulfone) (PAES), having a tenacity of from 4.8 to 9.5 CN/tex and an elongation at break of ≥100%.

10. The fiber according to claim 9, wherein the polymer comprises polymer chains that are functionalized at their ends by an amine or hydroxy group.

* * * * *